US011746502B2

(12) United States Patent
Yamamoto

(10) Patent No.: US 11,746,502 B2
(45) Date of Patent: Sep. 5, 2023

(54) EXCAVATOR AND INFORMATION PROCESSING DEVICE

(71) Applicant: SUMITOMO CONSTRUCTION MACHINERY CO., LTD., Tokyo (JP)

(72) Inventor: Takashi Yamamoto, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 238 days.

(21) Appl. No.: 17/014,187

(22) Filed: Sep. 8, 2020

(65) Prior Publication Data

US 2020/0399857 A1 Dec. 24, 2020

Related U.S. Application Data

(63) Continuation of application No. PCT/JP2019/001318, filed on Jan. 17, 2019.

(30) Foreign Application Priority Data

Mar. 30, 2018 (JP) ..... 2018-068983

(51) Int. Cl.
*E02F 9/22* (2006.01)
*E02F 9/20* (2006.01)
(Continued)

(52) U.S. Cl.
CPC ..... *E02F 9/2203* (2013.01); *E02F 9/2004* (2013.01); *E02F 9/2271* (2013.01); *E02F 9/26* (2013.01); *F15B 11/04* (2013.01); *F15B 21/087* (2013.01); *E02F 3/435* (2013.01); *E02F 9/2228* (2013.01); *E02F 9/2235* (2013.01); *E02F 9/2285* (2013.01); *E02F 9/2292* (2013.01); *E02F 9/2296* (2013.01); *F15B 2211/75* (2013.01); *F15B 2211/78* (2013.01)

(58) Field of Classification Search
CPC ... F15B 2211/78; F15B 2211/75; F15B 11/04; E02F 9/2203
See application file for complete search history.

(56) References Cited

U.S. PATENT DOCUMENTS

2002/0011013 A1* 1/2002 Sawada ..... E02F 3/437 37/443
2006/0156714 A1* 7/2006 Kim ..... E02F 9/2239 60/422

(Continued)

FOREIGN PATENT DOCUMENTS

| | | |
|---|---|---|
| JP | H05-033774 | 2/1993 |
| JP | 2002-038533 | 2/2002 |
| JP | 2016-173031 | 9/2016 |

OTHER PUBLICATIONS

International Search Report for PCT/JP2019/001318 dated Apr. 23, 2019.

*Primary Examiner* — Abiy Teka
(74) *Attorney, Agent, or Firm* — IPUSA, PLLC

(57) ABSTRACT

An excavator includes a plurality of hydraulic actuators, and a setting unit that performs a setting related to operation speeds of the plurality of hydraulic actuators during a combined operation of the hydraulic actuators, so that when the operation speed of one of the actuators increases, the operation speed of another one of the actuators decreases. The setting unit is capable of performing the setting for a plurality of kinds of combined operations.

8 Claims, 9 Drawing Sheets

(51) Int. Cl.

| | |
|---|---|
| ***E02F 9/26*** | (2006.01) |
| ***F15B 11/04*** | (2006.01) |
| ***F15B 21/08*** | (2006.01) |
| *E02F 3/43* | (2006.01) |

(56) References Cited

U.S. PATENT DOCUMENTS

2006/0179691 A1* 8/2006 Kim ..... E02F 9/2296
37/414
2007/0271913 A1* 11/2007 Ikeda ..... E02F 9/2239
60/421

* cited by examiner

EXCAVATOR AND INFORMATION PROCESSING DEVICE

CROSS REFERENCE TO RELATED APPLICATIONS

This application is a continuation application of International Application No. PCT/JP2019/001318 filed on Jan. 17, 2019 and designated the U.S., which is based upon and claims priority to Japanese Patent Application No. 2018-68983, filed on Mar. 30, 2018, the entire contents of each of which are hereby incorporated by reference.

BACKGROUND

1. Technical Field

The present disclosure relates to an excavator or the like.

2. Description of the Related Art

As related art, there is an excavator which can adjust, in a trade-off manner, operation speeds of two corresponding hydraulic actuators when a combined operation (for example, boom up and swing operation) is performed according to a setting operation made by an operator or the like.

SUMMARY

It is desirable to provide an excavator or the like capable of further improving the operability during combined operations.

According to one aspect of the embodiments, an excavator includes a plurality of hydraulic actuators; and a setting unit that performs a setting related to operation speeds of the plurality of hydraulic actuators during a combined operation of at least two hydraulic actuators among the plurality of hydraulic actuators, so that when the operation speed of a first one of the at least two actuators increases, the operation speed of a second one of the at least two actuators decreases, wherein the setting unit is configured to perform the setting for a plurality of kinds of combined operations.

According to another aspect of the embodiments, an information processing device communicable with a predetermined excavator, including a control device configured to perform, a setting related to operation speeds of at least two hydraulic actuators among a plurality of hydraulic actuators of the excavator during a combined operation of the at least two actuators, with respect to a plurality of kinds of combined operations as targets, or a display of contents of the setting in the excavator, with respect to the plurality of kinds of combined operations as targets.

Other objects and further features of the present invention will be apparent from the following detailed description when read in conjunction with the accompanying drawings.

DETAILED DESCRIPTION

Figure 1:
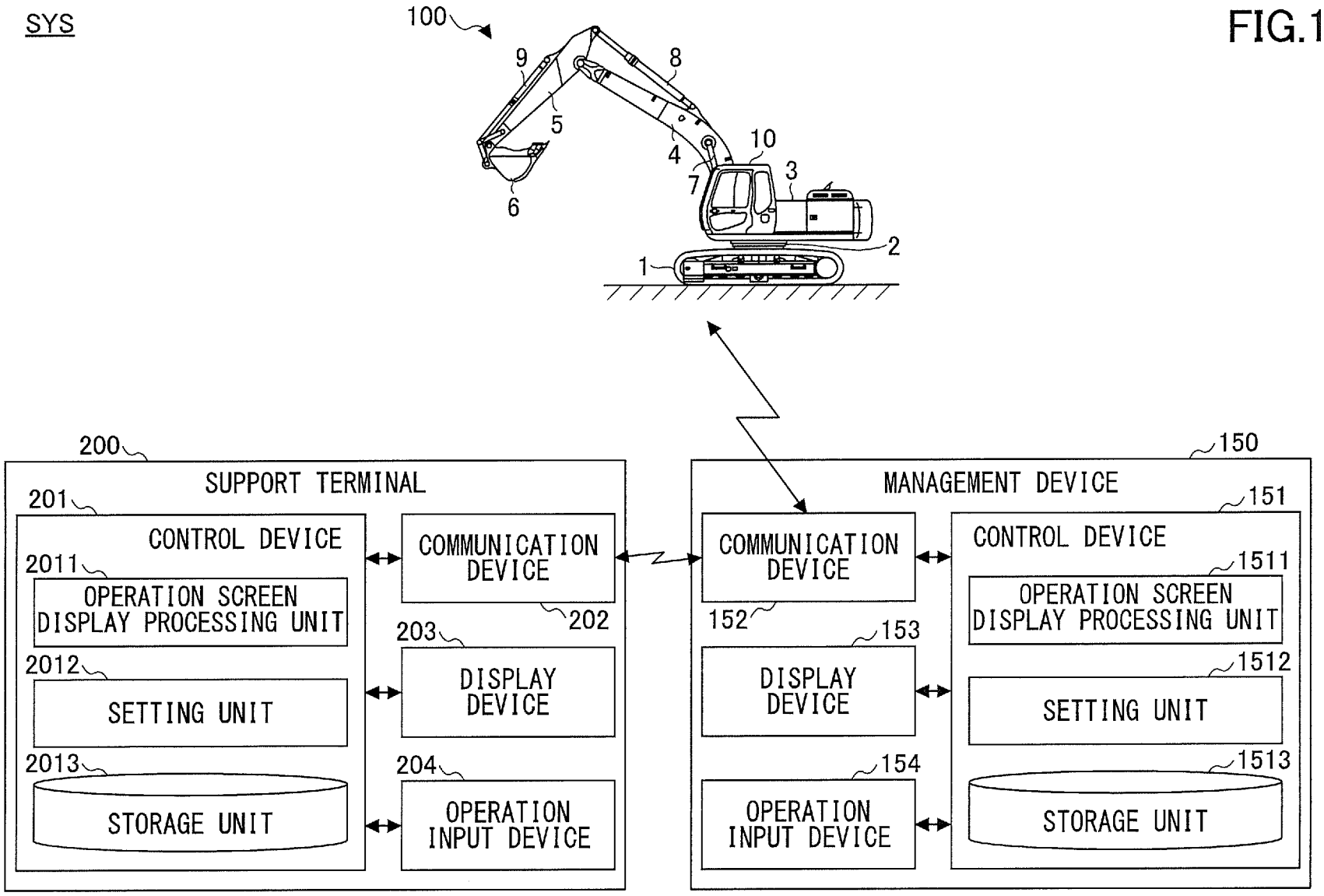
FIG. 1 is a diagram illustrating an example of a configuration of an excavator management system.

In the related art, because of the wide variety of excavator operations, a plurality of kinds of combined operations may be performed in actual operation. For this reason, although an adjustment function for a certain kind of combined operation can improve operability during the combined operation, there is room to improve operability for other combined operations.

Hereinafter, embodiments of the present invention will be described, by referring to the drawings.

[Overview of Excavator Management System]

First, an overview of an excavator management system SYS according to one embodiment will be described, by referring to FIG. 1.

FIG. 1 is a diagram illustrating an example of a configuration of the excavator management system SYS according to one embodiment.

The excavator management system SYS according to one embodiment includes an excavator 100, a management device 150, and a support terminal 200. One or a plurality of excavators 100 may be managed by the excavator management system SYS.

The excavator 100 according to one embodiment includes an undercarriage 1, an slewing upper structure 3 that is rotatably mounted on the undercarriage 1 via a slewing mechanism 2, attachments (working devices) including a boom 4, an arm 5, and a bucket 6, and a cabin 10.

The undercarriage 1 includes a pair of crawlers formed by right and left crawlers, and the respective crawlers are hydraulically driven by crawler hydraulic motors 1L and 1R (refer to FIG. 2), to cause the excavator 100 to crawl (be mobile).

Figure 2:
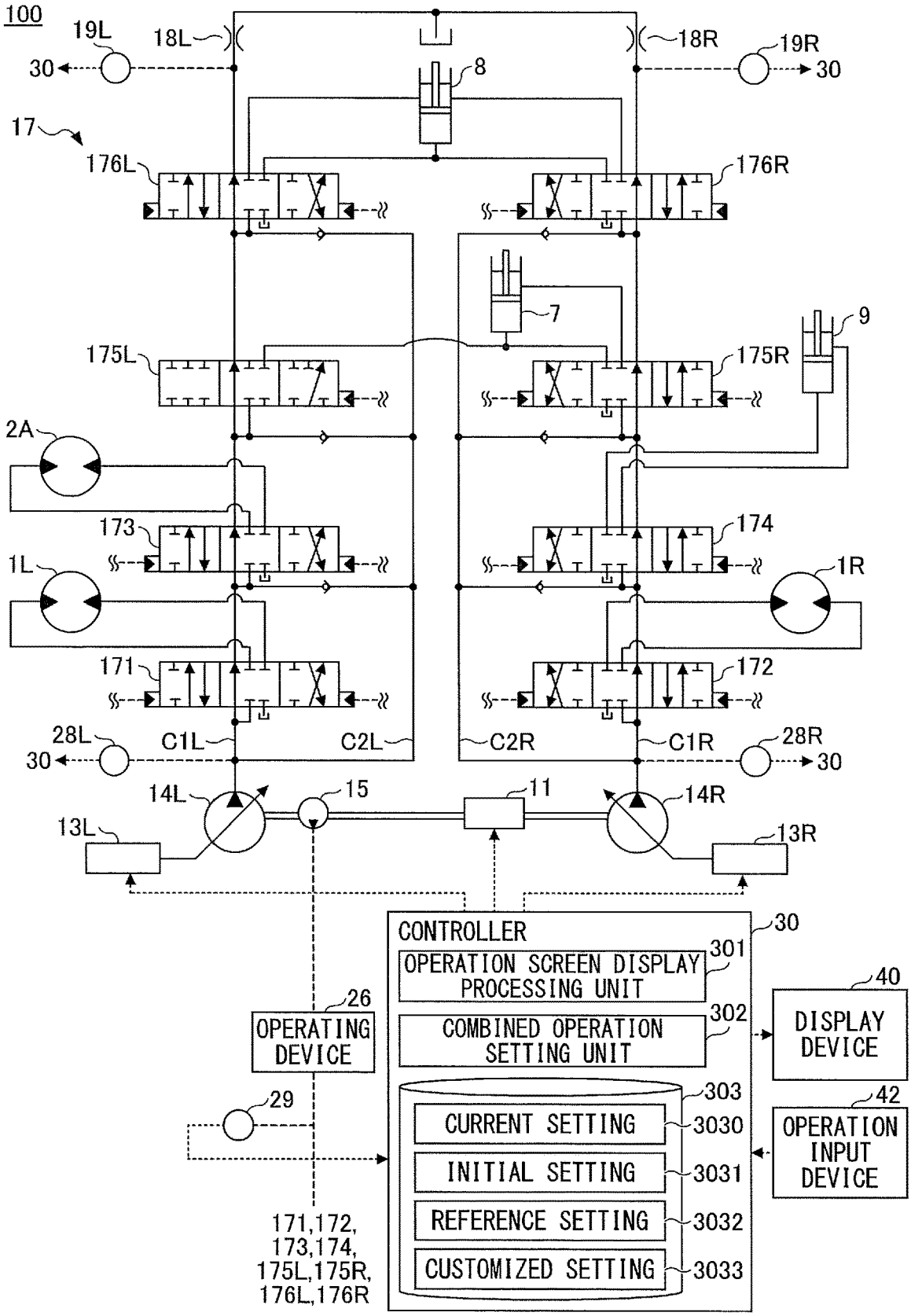
FIG. 2 is a diagram illustrating an example of a detailed configuration of the excavator.

The slewing upper structure 3 swings with respect to the undercarriage 1, by being driven by a swing hydraulic motor 21 (refer to FIG. 2).

The boom 4 is pivotally mounted at a front center of the slewing upper structure 3 and is able to pitch, the arm 5 is pivotally mounted at a tip end of the boom 4 and is able to swing up and down, and the bucket 6 is pivotally mounted at a tip end of the arm 5 and is able to swing up and down. The boom 4, the arm 5, and the bucket 6 are respectively hydraulically driven by a boom cylinder 7, an arm cylinder 8, and a bucket cylinder 9 that are provided as hydraulic actuators.

The cabin 10 is a craneman's house that is boarded by an operator or the like, and is mounted at a front left of the slewing upper structure 3.

The excavator 100 according to one embodiment is communicably connected to a management device 150 through an external communication network that may include a mobile communication network having a base station as a terminal, a satellite communication network using a communication satellite in the sky, the Internet network, or the like, for example.

The management device 150 (an example of an information processing device) is communicably connected to the excavator 100 through the external communication network. In addition, the management device 150 is communicably connected to the support terminal 200 through an external communication network that may include a mobile communication network having a base station as a terminal, a satellite communication network using a communication satellite in the sky, the Internet network, or the like, for example. Moreover, the management device 150 may be a server device, set up at a management center of the excavator 100, remotely located from a work site of the excavator 100. Further, the management device 150 may be a fixed terminal, such as a desktop computer terminal or the like, set up in an office or the like managing the work site of the excavator 100. In addition, the management device 150 may be a portable terminal (for example, a tablet terminal, a laptop computer terminal, or the like) that can be carried out from the management center of the excavator 100 or the office or the like managing the work site of the excavator 100.

The support terminal 200 (an example of an information processing device) is communicably connected to the management device 150 through an external communication network. The support terminal 200 may be a portable terminal, such as a smartphone, a tablet terminal, or the like, for example, used by a user such as a supervisor or operator of the work site.

[Configuration of Excavator Management System]

Next, the configuration of the excavator management system SYS including the excavator 100 will be described, with reference to FIG. 2 in addition to FIG. 1.

FIG. 2 is a diagram illustrating an example of the detailed configuration of the excavator 100 according to one embodiment.

In FIG. 2, a mechanical power line is represented by a double line, a high-pressure hydraulic line is represented by a solid line, a pilot line is represented by a dashed line, and an electric drive and control line is represented by a dotted line.

<Configuration of Excavator>

A hydraulic driving system for hydraulically driving the hydraulic actuator of the excavator 100 according to one embodiment includes an engine 11, main pumps 14L and 14R, and a control valve 17. In addition, the hydraulic driving system of the excavator 100 according to one embodiment includes hydraulic actuators such as the crawler hydraulic motors 1L and 1R, a swing hydraulic motor 2A, the boom cylinder 7, the arm cylinder 8, and the bucket cylinder 9, for hydraulically driving the undercarriage 1, the slewing upper structure 3, the boom 4, the arm 5, and the bucket 6, respectively, as described above.

The engine 11 is the main power source of the hydraulic driving system, and is mounted at the rear of the slewing upper structure 3, for example. More particularly, the engine 11 rotates at a constant target rotational speed that is preset, under a control of a controller 30, and drives the main pumps 14L and 14R and the pilot pump 15. The engine 11 is a diesel engine that uses a light oil as the fuel.

The main pumps 14L and 14R are mounted at the rear of the slewing upper structure 3, for example, similar to the engine 11, and supply a hydraulic oil to the control valve 17 via the high-pressure hydraulic lines. The main pumps 14L and 14R are respectively driven by the engine 11 as described above. The main pumps 14L and 14R are variable capacity hydraulic pumps, for example, and are capable of controlling a discharge flow rate (a discharge pressure), by adjusting a stroke length of a piston by controlling an angle (an inclination angle) of a swash plate by regulators 13L and 13R under a control of the controller 30 that will be described later.

The control valve 17 is mounted at a center portion of the slewing upper structure 3, for example, and is a hydraulic control device that controls the hydraulic driving system according to an operation performed by the operator or the like with respect to an operating device 26. As described above, the control valve 17 connects to the main pumps 14L and 14R via the high-pressure hydraulic lines, and selectively supplies the hydraulic oil supplied from the main pumps 14L and 14R to the hydraulic actuators including the crawler hydraulic motors 1L (for left crawler) and 1R (for right crawler), the swing hydraulic motor 2A, the boom cylinder 7, the am cylinder 8, and the bucket cylinder 9, according to an operating state of the operating device 26. More particularly, the control valve 17 includes control valves 171, 172, 173, 174, 175L, 175R, 176L, and 176R that control the flow rate and the direction of flow of the hydraulic oil supplied from the main pumps 14L and 14R to each of the hydraulic actuators.

The hydraulic driving system circulates the hydraulic oil from each of the main pumps 14L and 14R driven by the engine 11 to a hydraulic oil tank through center bypass oil passages C1L and C1R, and parallel oil passages C2L and C2R.

The center bypass oil passage C1L starts from the main pump 14L, and reaches the hydraulic oil tank by successively passing through the control valves 171, 173, 175L, and 176L arranged in the control valve 17. The center bypass oil passage C1R starts from the main pump 14R, and reaches the hydraulic tank by successively passing through the control valves 172, 174, 175R, and 176R arranged in the control valve 17.

The control valve 171 is a spool valve that supplies the hydraulic oil discharged from the main pump 14L to the crawler hydraulic motor 1L, and discharges the hydraulic oil discharged from the crawler hydraulic motor 1L to the hydraulic oil tank.

The control valve 172 is a spool valve that supplies the hydraulic oil discharged from the main pump 14R to the crawler hydraulic motor 1R, and discharges the hydraulic oil discharged from the crawler hydraulic motor 1R to the hydraulic oil tank.

The control valve 173 is a spool valve that supplies the hydraulic oil discharged from the main pump 14L to the swing hydraulic motor 2A, and discharges the hydraulic oil discharged from the swing hydraulic motor 2A to the hydraulic oil tank.

The control valve 174 is a spool valve that supplies the hydraulic oil discharged from the main pump 14R to the bucket cylinder 9, and discharges the hydraulic oil in the bucket cylinder 9 to the hydraulic oil tank.

The control valves 175L and 175R are spool valves that respectively supply the hydraulic oil discharged from the main pumps 14L and 14R to the boom cylinder 7, and discharge the hydraulic oil in the boom cylinder 7 to the hydraulic oil tank.

The control valves 176L and 176R respectively supply the hydraulic oil discharged from the main pumps 14L and 14R to the arm cylinder 8, and discharge the hydraulic oil in the arm cylinder 8 to the hydraulic oil tank.

The control valves 171, 172, 173, 174, 175L, 175R, 176L, and 176R respectively adjust the flow rate of and switch the direction of flow of the hydraulic oil supplied to and discharged from the hydraulic actuators and switch the direction of flow, according to a pilot pressure acting on a pilot port.

The parallel oil passage C2L supplies the hydraulic oil of the main pump 14L to the control valves 171, 173, 175L, and 176L in parallel with the center bypass oil passage C1L. More particularly, the parallel oil passage C2L branches from the center bypass oil passage C1L on an upstream side of the control valve 171, and is configured to be able to supply the hydraulic oil of the main pump 14L in parallel to each of the control valves 171, 173, 175L, and 176L. Accordingly, the parallel oil passage C2L can supply the hydraulic oil to the control valve on a downstream side when the flow of the hydraulic oil through the center bypass oil passage C1L is restricted or interrupted by any one of the control valves 171, 173, and 175L.

The parallel oil passage C2R supplies the hydraulic oil of the main pump 14R to the control valves 172, 174, 175R, and 176R in parallel with the center bypass oil passage C1R. More particularly, the parallel oil passage C2R branches from the center bypass oil passage C1R on an upstream side of the control valve 172, and is configured to be able to supply the hydraulic oil of the main pump 14R in parallel to each of the control valves 172, 174, 175R, and 176R. The parallel oil passage C2R can supply hydraulic oil to the control valve on a downstream side when the flow of the hydraulic oil through the center bypass oil passage C1R is restricted or interrupted by any one of the control valves 172, 174, and 175R.

An operating system of the excavator 100 according to one embodiment includes the pilot pump 15 and the operating device 26.

The pilot pump 15 is mounted at the rear of the slewing upper structure 3, for example, similar to the engine 11, and supplies the pilot pressure to the operating device 26 via a pilot line 25. The pilot pump 15 is a fixed capacitive hydraulic pump, for example, and is driven by the engine 11 as described above.

The operating device 26 is provided near an operator's seat in the cabin 10, and is an operation input means to be manipulated by the operator or the like to operate various operation elements (the undercarriage 1, the slewing upper structure 3, the boom 4, the arm 5, the bucket 6, or the like). In other words, the operating device 26 is an operation input means for operating the hydraulic actuators (that is, the crawler hydraulic motors 1L and 1R, the swing hydraulic motor 2A, the boom cylinder 7, the arm cylinder 8, the bucket cylinder 9, or the like) that drive the respective operation elements. The operating device 26 includes four lever devices that operate each of the slewing upper structure 3, the boom 4, the arm 5, and the bucket 6, for example. In addition, the operating device 26 includes two lever devices or pedal devices that operate each of the left crawler and the right crawler of the undercarriage 1 (that is, the crawler hydraulic motors 1L and 1R), for example. The operating device 26 is connected to the control valve 17 via the pilot line. Hence, the control valve 17 receives a pilot signal (pilot pressure) corresponding to the operating state of the undercarriage 1, the slewing upper structure 3, the boom 4, the arm 5, and the bucket 6 on the operating device 26. More particularly, secondary pilot pressures of the two lever devices or pedal devices operating the left crawler (crawler hydraulic motor 1L) and the right crawler (crawler hydraulic motor 1R) act on the pilot ports of the control valves 171 and 172, respectively. In addition, a secondary pilot pressure of the lever device operating the slewing upper structure 3 (swing hydraulic motor 2A) acts on the pilot port of the control valve 173. Moreover, a secondary pilot pressure of the lever device operating the boom 4 (boom cylinder 7) acts on the pilot ports of the control valves 175L and 175R. Furthermore, a secondary pilot pressure of the lever device operating the arm 5 (arm cylinder 8) acts on the pilot ports of the control valves 176L and 176R. In addition, a secondary pilot pressure of the lever device operating the bucket 6 (bucket cylinder 9) acts on the pilot port of the control valve 174. Hence, the control valve 17 can drive the respective hydraulic actuators according to the operating state of the operating device 26.

A control system of the excavator 100 according to one embodiment includes the controller 30, the regulators 13L and 13R, negative control restrictors (hereinafter referred to as "negative restrictors") 18L and 18R, negative control pressure sensors 19L and 19R, a discharge pressure sensor 28, an operating pressure sensor 29, a display device 40, an operation input device 42, and a communication device 44.

The controller 30 drives and controls the excavator 100. Functions of the controller 30 may be implemented by arbitrary hardware, or a combination of hardware and software. For example, the controller 30 is mainly formed by a microcomputer including a Central Processing Unit (CPU), a Read Only Memory (ROM), a Random Access Memory (RAM), a non-volatile auxiliary storage device, various input and output interfaces, or the like. The controller 30 performs various functions by executing various programs stored in the ROM or the non-volatile auxiliary storage device by the CPU, for example. The same applies to a control device 151 of the management device 150, and a control device 201 of the support terminal 200 described later.

For example, the controller 30 sets the target rotational speed based on an operation mode that is preset by the operator or the like, and drives and controls the engine 11 to undergo a constant rotation, either directly or through a dedicated control device of the engine 11.

For example, the controller 30 controls the regulators 13L and 13R, and adjusts the inclination angle of the swash plate of the main pumps 14L and 14R, to control the discharge rates of the main pumps 14L and 14R.

More particularly, the controller 30 may control the regulators 13L and 13R according to the discharge pressures of the main pumps 14L and 14R detected by discharge pressure sensors 28L and 28R, to control the discharge rates of the main pumps 14L and 14R. More specifically, the controller 30 may adjust the inclination angle of the swash plate the main pump 14L according to an increase in the discharge pressure of the main pump 14L, through the regulator 13L, to reduce the discharge rate. The same applies to the regulator 13R. Accordingly, the controller 30 can control a gross horsepower of the main pumps 14L and 14R, so that an absorbing horsepower of the main pumps 14L and 14R, expressed by a product of the discharge pressure and the discharge rate, does not exceed an output horsepower of the engine 11.

In addition, the controller 30 may control the regulators 13L and 13R according to detection signals input from the negative control pressure sensors 19L and 19R and corresponding to the control pressures (hereinafter, the "negative control pressures") generated by the negative control restrictors 18L and 18R, to control the discharge rate of the main pumps 14L and 14R. More specifically, the controller 30 decreases the discharge rate of the main pumps 14L and 14R as the negative control pressure increases, and increases the discharge rate of the main pumps 14L and 14R as the negative control pressure decreases.

In a standby state where none of the hydraulic actuators in the excavator 100 is operated (the state in FIG. 2), the hydraulic oil discharged from the main pumps 14L and 14R passes through the center bypass oil passages C1L and C1R and reaches the negative control restrictors 18L and 18R. The flow of hydraulic oil discharged from the main pumps 14L and 14R increases the negative control pressure generated on the upstream side of the negative control restrictors 18L and 18R. As a result, the controller 30 decreases the discharge rate of the main pumps 14L and 14R to a tolerable minimum discharge rate, to reduce a pressure loss (pumping loss) when the discharged hydraulic oil passes through the center bypass oil passages C1L and C1R.

On the other hand, when one of the hydraulic actuators is operated by the operating device 26, the hydraulic oil discharged from the main pumps 14L and 14R flows into the hydraulic actuator that is the target to be operated, through the control valve corresponding to the hydraulic actuator that is the target to be operated. The flow of the hydraulic oil discharged from the main pumps 14L and 14R causes an amount reaching the negative control restrictors 18L and 18R to decrease or disappear, to lower the negative control pressure generated on the upstream side of the negative control restrictors 18L and 18R. As a result, the controller 30 can increase the discharge rate of the main pumps 14L and 14R, and circulate a sufficient amount of the hydraulic oil to the hydraulic actuator that is the target to be operated, to positively drive the hydraulic actuator that is the target to be operated.

Accordingly, in the standby state of the hydraulic driving system, the controller 30 can reduce wasteful energy consumption of the main pumps 14L and 14R, including the pumping loss in the center bypass oil passages C1L and C1R generated by the hydraulic oil discharged from the main pumps 14L and 14R. In addition, when the hydraulic actuator operates, the controller 30 can supply the necessary and sufficient hydraulic oil from the main pumps 14L and 14R to the hydraulic actuator that is the target to be operated.

Moreover, when a combined operation in which two hydraulic actuators are operated simultaneously by the operating device 26 (hereinafter simply referred to as a "combined operation") is performed, the controller 30 controls the regulators 13L and 13R and controls the discharge amount of the main pumps 14L and 14R, so that the two hydraulic actuators operate according to preset contents. More specifically, during the combined operation by the operating device 26, the controller 30 controls the regulators 13L and 13R so that a flow rate distribution of the hydraulic oil supplied to the two hydraulic actuators is adjusted to the preset contents (contents of a current setting 3030 of a storage unit 303 to be described later), as will be described later. For example, in a combined operation (hereinafter referred to as a "boom up and swing") in which an operation in a raising direction of the boom 4 (hereinafter, referred to as the "boom up") and a swing operation of the slewing upper structure 3 are performed simultaneously, the swing hydraulic motor 2A driven by the hydraulic oil supplied from the main pump 14L, and the boom cylinder 7 supplied with the hydraulic oil from both the main pumps 14L and 14R, operate. In this case, since the hydraulic oil flows to the swing hydraulic motor 2A from the upstream side (side of the main pump 14L) of the boom cylinder 7 in the center bypass oil passage C1L, the controller 30 can increase the flow rate of the swing hydraulic motor 2A relatively due to the increase in the discharge amount of the main pump 14L. On the other hand, since the boom cylinder 7 may receive the hydraulic oil not only from the main pump 14L but also from the main pump 14R, the controller 30 can increase the flow rate of the boom cylinder 7 relatively due to the increase in the discharge amount of the main pump 14R. Accordingly, the controller 30 can adjust the flow rate of the hydraulic oil supplied to the two hydraulic actuators so as to become the contents that are set as will be described later, by controlling the discharge amount of the main pumps 14L and 14R during the combined operation, based on the operating state of the operating device 26.

For example, the controller 30 sets relative reactivities of the two hydraulic actuators (hereinafter simply referred to as "relative reactivities") with respect to an operation input to the operating device 26 during the combined operation, according to the operation performed by a user, such as the operator or a service person, with respect to the operation input device 42. The controller 30 includes an operation screen display processing unit 301 and a combined operation setting unit 302, as functional units that are related to setting of the relative reactivities of the two hydraulic actuators during the combined operation (hereinafter referred to as a relative reactivity setting) and realized by executing one or more programs stored in a non-volatile auxiliary storage device, for example. The controller 30 also includes the storage unit 303, as a storage area that is related to the relative reactivity setting, prescribed in a non-volatile internal memory such as the auxiliary storage device or the like, for example.

A portion of the functions of the controller 30 may be implemented by other controllers. In other words, the functions of the controller 30 may be implemented in a manner distributed among a plurality of controllers.

The regulators 13L and 13R adjust the discharge rates of the main pumps 14L and 14R, by adjusting the inclination angles of the swash plates of the main pumps 14L and 14R, respectively, under the control of the controller 30.

The negative control restrictors 18L and 18R are respectively provided between the hydraulic oil tank and the control valves 176L and 176R that are located at most downstream sides of the center bypass oil passages C1L and C1R, respectively. Accordingly, the flow of hydraulic oil discharged by the main pumps 14L and 14R is restricted by the negative control restrictors 18L and 18R, and the negative control restrictors 18L and 18R generate the negative control pressures described above.

The negative control pressure sensors 19L and 19R detect the negative control pressures, and detection signals corresponding to the detected negative control pressures are input to the controller 30.

The discharge pressure sensors 28L and 28R detect the discharge pressures of the main pumps 14L and 14R, respectively, and detection signals corresponding to the detected discharge pressures are input to the controller 30.

The operating pressure sensor 29 detects the pilot pressure on the secondary side of the operating device 26, that is, the pilot pressure corresponding to the operating state of each operating element (hydraulic actuator) in the operating device 26. The detection signal of the pilot pressure corresponding to the operating state of the undercarriage 1, the slewing upper structure 3, the boom 4, the arm 5, the bucket 6, or the like in the operating device 26, by an operating pressure sensor 29, is input to the controller 30.

The display device 40 is provided at a location (for example, a pillar portion at the front right of the cabin 10), within the cabin 10 near the operator's seat, easily visible by the operator or the like, and displays various information screens under the control of the controller 30. The display device 40 is a liquid crystal display or an organic Electro- Luminescence (EL) display, for example, and may be a touchscreen panel that also serves as an operating unit. In the following, the same applies to a display device 153 of the management device 150, and a display device 203 of the support terminal 200.

The operation input device 42 is provided within a range manually accessible from the operator or the like in a seated position inside the cabin 10, and receives various operations from the operator or the like. The operation input device 42 includes a touchscreen panel implemented in a display of the display device 40 for displaying various information images, a touch pad provided separately from the display of the display device 40, a knob switch provided at a tip of a lever portion of a lever device included in the operating device 26, and a button switch, a lever, a toggle, or the like provided around the display device 40 or provided at a location relatively remote from the display device 40. A signal corresponding to operation contents with respect to the operation input device 42 is input to the controller 30.

The communication device 44 connects to an external communication network of the excavator 100, that may include a mobile communication network having a base station as a terminal, a satellite communication network using a communication satellite in the sky, the Internet network, or the like, for example, and communicates with an external device including the management device 150.

The operation screen display processing unit 301 displays various operation screens that are operable using the operation input device 42, on the display device 40. For example, the operation screen display processing unit 301 displays an operation screen (hereinafter referred to as a "setting target combined operation selection screen") for selecting, from among a plurality of kinds of prescribed combined operations, a combined operation that is a target to be set with the relative reactivity (or checked), an operation screen (hereinafter referred to as a "relative reactivity setting screen") for setting (or checking) the relative reactivity, or the like. Hence, the operator or the like of the excavator 100 can set the relative reactivities of the two hydraulic actuators during the combined operation for each of a plurality of kinds of combined operations, and check the set state thereof. Details will be described later (refer to FIG. 3, FIG. 4A to FIG. 4D, and FIG. 5).

The combined operation setting unit 302 (an example of a setting unit) sets the relative reactivities of the two hydraulic actuators during the combined operation for each of the plurality of kinds of combined operations, according to a user operation with respect to the relative reactivity setting screen performed through the operation input device 42. The operation with respect to the relative reactivity setting screen may include not only the operation from the touchscreen panel that can directly perform an operation on the setting screen, but naturally also the operation with respect to an operation target, such as a cursor, an icon, or the like on the operation screen that may be included in the operation input device 42 through arbitrary hardware. The relative reactivities of the two hydraulic actuators during the combined operation refers to a distribution ratio of operation speeds of the two hydraulic actuators when the two hydraulic actuators are operated simultaneously, and a trade-off relationship stands such that the operation speed of one of the two hydraulic actuators decreases when the other of the two hydraulic actuators increases. More specifically, the relative reactivities of the two hydraulic actuators during the combined operation, that is, the operation speeds of the two hydraulic actuators in the trade-off relationship, may include a reaction time of each of the two hydraulic actuators from the operation on each of the two hydraulic actuators to the start of acting thereof when the two hydraulic actuators are operated simultaneously, the operation speed of each of the two hydraulic actuators, an acting acceleration, or the like. In other words, the relative reactivities of the two hydraulic actuators during the combined operation indicates a relative priority as to which of the two hydraulic actuators is to be operated preferentially. The relative reactivities of the two hydraulic actuators may be varied, for example, by adjusting the flow rate distribution of the hydraulic oil supplied to the two hydraulic actuators. In other words, the combined operation setting unit 302 may set the flow rate distribution of the hydraulic oil to the two hydraulic actuators, as the relative reactivities of the two hydraulic actuators during the combined operation, for each of the plurality of kinds of prescribed combined operations, according to the user operation with respect to the relative reactivity setting screen. The combined operation setting unit 302 stores the contents set for each of the plurality of kinds of combined operations, as the current setting 3030 in the storage unit 303. In this state, the current setting 3030 may be stored in the storage unit 303 in a manner associated with identification information of the current operator of the excavator 100 (for example, an operator Identifier (ID) prescribed for each of a plurality of operators (hereinafter referred to as "operator identification information"). For example, when starting the excavator 100, an operation screen (hereinafter referred to as an "operator selection screen") for selecting the operator who is to actually perform the operation from among a plurality of pre-registered operators is displayed on the display device 40, and the controller 30 may identify the operator of the excavator 100 according to operation contents (selection contents) of the operator or the like. In addition, an indoor camera for capturing a face of the operator in the operator's seat, is provided inside the cabin 10, and the controller 30 may identify the operator of the excavator 100 from among the plurality of pre-registered operators, based on an image recognition result with respect to an image captured by the indoor camera. Hence, the controller 30 can identify the current operator of the excavator 100, and associate the operator identification information corresponding to the current operator to the current setting 3030. Moreover, the combined operation setting unit 302 transmits the contents set for each of the plurality of kinds of combined operations, that is, the contents of the current setting 3030, to the management device 150 via the communication device 44. Thus, an administrator or the like of the management device 150 can check the currently set contents related to the relative reactivities of the two hydraulic actuators during the combined operation of the excavator 100. Further, when the contents of the current setting 3030 are associated with the operator identification information, the administrator or the like of the management device 150 can understand the set contents related to which relative reactivities are used for each operator.

In addition, the combined operation setting unit 302 may set, according to a command (hereinafter referred to as a "set command") from the management device 150, the relative reactivities of the two hydraulic actuators during the combined operation specified by the set command from among the plurality of kinds of combined operations, to requested contents specified by the set command. In this case, the combined operation setting unit 302 stores the contents of each of the plurality of kinds of combined operations set according to the set command from the management device 150, as the current setting 3030 in the storage unit 303. Moreover, the combined operation setting unit 302 transmits the contents of each of the plurality of kinds of combined operations, set according to the set command from the management device 150, to the management device 150 via the communication device 44. Thus, the administrator or the like of the management device 150 can check that the setting related to the relative reactivities of the two hydraulic actuators during the combined operation of the excavator 100 has been made according to the set command from the management device 150.

In addition to the current setting 3030 of the relative reactivities of the two hydraulic actuators for each of the plurality of kinds of combined operations, the storage unit 303 includes an initial setting 3031 of the relative reactivities of the two hydraulic actuators, a reference setting 3032, and a customized setting 3033, for each of the plurality of kinds of combined operations.

The initial setting 3031 is the contents that are preset as the relative reactivities of the two hydraulic actuators during the combined operation, in a state where no setting is made by the user. For example, the current setting 3030 is set to the contents of the initial setting 3031 when the excavator 100 is forwarded from a factory. The combined operation setting unit 302 may return the relative reactivities of the two hydraulic actuators during the combined operation, changed from the state corresponding to the initial setting 3031, back to the initial setting 3031 according to an operation performed by the user through the operation input device 42. Hence, even after once changing the relative reactivities of the two hydraulic actuators during the combined operation, the user can return the setting to the state corresponding to the initial setting 3031 (refer to FIG. 5).

The reference setting 3032 is the contents of a reference setting related to the relative reactivities of the two hydraulic actuators during the combined operation, and is the contents of a recommended setting considered by a manufacturer of the excavator 100 as being suited for most users based on other specifications or the like, for example. The reference setting 3032 is prepared for each of a plurality of accessory specifications applicable to the excavator 100. For example, the reference setting 3032 may be prepared and stored in the storage unit 303 for each of "standard specification", "quick coupling specification" (connection of an end attachment conforms to the specification of quick coupling), and "long arm specification", as attachment specifications. In addition, the contents of the reference setting 3032 may be downloaded from the management device 150 and stored in the storage unit 303. The combined operation setting unit 302 may set the relative reactivities of the two hydraulic actuators during the combined operation to the contents of the reference setting 3032, according to the operation performed by the user through the operation input device 42 (refer to FIG. 5). Hence, the user can use the contents of the reference setting 3032 as the relative reactivities of the two hydraulic actuators during the combined operation. In this case, the contents of the reference setting 3032 are stored in the current setting 3030.

The customized setting 3033 is set contents related to the relative reactivities of the two hydraulic actuators during the combined operation, registered according to user preference. For example, the combined operation setting unit 302 (an example of a registration unit) registers the currently set relative reactivities (that is, the contents of the current setting 3030) of the two hydraulic actuators during the combined operation in the storage unit 303, as the customized setting 3033, according to the user operation performed through the operation input device 42. Accordingly, by pre-registering the contents of the user's favorite setting related to the relative reactivities of the two hydraulic actuators during the combined operation, as the customized setting 3033, the user can thereafter simply utilize the set contents (refer to FIG. 5). In addition, the contents of the customized setting 3033 may be registered in the management device 150 or the support terminal 200, and downloaded from the management device 150. The customized setting 3033 may be registered for each of the plurality of operators who may operate the excavator 100.

A part or all of the current setting 3030, the initial setting 3031, the reference setting 3032, and the customized setting 3033 may be stored (registered) in mutually different storage units (for example, mutually different storage devices among a plurality of storage devices formed by at least one of auxiliary storage devices provided internally in the controller 30 and external storage devices connected externally to the controller 30).

<Configuration of Management Device>

As illustrated in FIG. 1, the management device 150 includes a control device 151, a communication device 152, a display device 153, and an operation input device 154.

The management device 150 displays the above described setting target combined operation selection screen, the relative reactivity setting screen, or the like on the display device 153, when a predetermined application program having functions similar to those of the above described operation screen display processing unit 301 and the combined operation setting unit 302 is started. The management device 150 may set the relative reactivities of the two hydraulic actuators during the combined operation, according to a setting operation on the relative reactivity setting screen using the operation input device 154, performed by the user, such as the administrator, the operator, or the like, and transmit the set contents to the excavator 100 through the communication device 152. Accordingly, the controller 30 of the excavator 100 can control the relative reactivities of the two hydraulic actuators during the combined operation, specifically, the flow rate distribution to the two hydraulic actuators as described above, based on the set contents received from the management device 150. A more detailed description will follow.

The control device 151 performs various control processes related to the management device 150. The control device 151 includes an operation screen display processing unit 1511, and a setting unit 1512, as functional units that are implemented by executing one or more programs installed in the ROM or an auxiliary storage device by the CPU, for example. In addition, the control device 151 may use a storage unit 1513. The storage unit 1513 may be implemented by an auxiliary storage device provided internally in the management device 150, an external storage device connected externally to the management device 150, or the like.

The communication device 152 is connected to the external communication network that may include the mobile communication network having the base station as the terminal, the satellite communication network using the communication satellite in the sky, the Internet network, or the like, for example, and communicates with the external devices including the excavator 100 and the support terminal 200.

The display device 153 displays various information images and Graphical User Interface (GUI) under the control of the control device 151.

The operation input device 154 receives the operation input from the administrator or the operator (hereinafter, referred to as the "administrator or the like") of the management device 150, and outputs the input to the control device 151. The operation input device 154 may be a touchscreen panel implemented in the display device 153, for example.

The operation screen display processing unit 1511 displays an operation screen (that is, a setting target combined operation selection screen) for selecting the combined operation having the relative reactivities, that is a target to be set or a target to be checked, from among the plurality of kinds of prescribed combined operations in the excavator 100, or an operation screen (that is, the relative reactivity setting screen) for setting or checking the relative reactivities of the two hydraulic actuators during the combined operation of the excavator 100, on the display device 153. In addition, when targets to be managed by the management device 150 include a plurality of excavators 100, the operation screen display processing unit 1511 may display the setting target combined operation selection screen and the relative reactivity setting screen, for each of the plurality of excavators 100. Moreover, as described above, when the contents of the current setting 3030 associated with the operator identification information of the current operator of the excavator 100 are uploaded from the excavator 100 to the management device 150, the operation screen display processing unit 1511 may display the setting target combined operation selection screen or the relative reactivity setting screen for each of the plurality of operators mounted on the excavator 100. In this case, the operation screen display processing unit 1511 may display an operation screen (hereinafter referred to as an "excavator and operator selection screen") for selecting the excavator 100 and the operator as the targets to be set, from among the plurality of pre-registered excavators 100 and pre-registered operators, as a stage preceding the stage of displaying the setting target combined operation selection screen. Details thereof will be described later (refer to FIG. 3, FIG. 4A through FIG. 4D, FIG. 5, and FIG. 6).

In addition, the operation screen display processing unit 1511 transmits information (hereinafter referred to as "display resources") for displaying the target combined operation selection screen, the relative reactivity setting screen, the excavator and operator selection screen, or the like on the display device 203 of the support terminal 200, according to a display request for the setting target combined operation selection screen, the relative reactivity setting screen, the excavator and operator selection screen, or the like received from the support terminal 200. Hence, the user of the support terminal 200 can set the relative reactivities of the two hydraulic actuators during each of the plurality of kinds of combined operations of the excavator 100, and check the set state thereof.

Similar to the combined operation setting unit 302 of the excavator 100, the setting unit 1512 sets the relative reactivities of the two hydraulic actuators during the combined operation that is the target to be set among the plurality of kinds of combined operations, according to the operation performed by the administrator or the like through the operation input device 154 with respect to the relative reactivity setting screen. More particularly, the setting unit 1512 can set the relative reactivities of the two hydraulic actuators during the combined operation of the excavator 100, by transmitting the set command including the set contents input through the operation input device 154, to the excavator 100 through the communication device 152. In this state, the set command includes the combined operation, that is the target to be set among the plurality of kinds combined operations, specified by the administrator or the like, and a requested value of the relative reactivity requirements of the two hydraulic actuators during the combined operation that is set. Hereinafter, the same applies to the following set request transmitted from the support terminal 200 to the management device 150. Hence, the administrator or the like of the management device 150 can set the relative reactivities of the excavator 100 that is the target to be managed, from a location external to (remote from) the excavator 100. In addition, when the targets to be managed by the management device 150 include the plurality of excavators 100, the setting unit 1512 can set the relative reactivities of the two hydraulic actuators during the combined operation that is the target to be set among the plurality of kinds of combined operations, for each of the plurality of excavators 100. Further, as described above, when the contents of the current setting 3030 associated with the operator identification information of the current operator of the excavator 100 are uploaded from the excavator 100 to the management device 150, the setting unit 1512 can set the relative reactivities of the two hydraulic actuators during the combined operation that is the target to be set among the plurality of kinds of combined operations, for each of the plurality of operators boarding the plurality of excavators 100.

Moreover, the setting unit 1512 transmits to the excavator 100 a set command including contents (for example, the excavator identification information or the operator identification information, the combined operation that is the target to be set among the plurality of kinds of combined operations, the requested values of the relative reactivity values of the two hydraulic actuators during the combined operation that is the target to be set, or the like) specified by the set request, according to a request (hereinafter referred to as a "set request") related to the relative reactivity setting of the excavator 100 received from the support terminal 200. Hence, the user of the support terminal 200 can set, via the management device 150, the relative reactivities of the two hydraulic actuators during the combined operation, for each of the plurality of kinds of combined operations of the excavator 100. In addition, when the targets to be managed include the plurality of excavators 100, the setting unit 1512 can specify the excavator 100 that is the target to be set among the plurality of excavators 100, based on the excavator identification information specified by the set request from the support terminal 200, and transmit the set command with respect to the specified excavator 100. Accordingly, the user of the support terminal 200 can set the relative reactivities of the two hydraulic actuators during the combined operation of one excavator 100 selected from the plurality of excavators 100. In other words, the support terminal 200 can set the relative reactivities of the two hydraulic actuators during the combined operation, for each of the plurality of kinds of combined operations, and for each of the plurality of excavators 100, according to the user operation. Further, the setting unit 1512 can specify the operators who are currently operating the plurality of excavators 100 when operator identification information is associated with the current setting 3030. The setting unit 1512 can specify the operator that is the target to be set among the plurality of operators, based on the operator identification information specified by the set request from the support terminal 200, and transmit the set command to the excavator 100 that is boarded by the specified operator. Thus, the user of the support terminal 200 can set the relative reactivities of the two hydraulic actuators during the combined operation of the excavator 100 operated by the one operator selected from the plurality of operators. In other words, the support terminal 200 can set the relative reactivities of the two hydraulic actuators during the combined operation, for each of the plurality of kinds of combined operations, and for each of the plurality of operators, according to the user operation.

Similar to the storage unit 303 of the excavator 100, the storage unit 1513 stores the contents of the current setting related to the relative reactivities of the two hydraulic actuators during the combined operation of the excavator 100, the contents of the initial setting, the contents of the reference setting, and the contents of the customized setting that are registered according to the user preference.

<Configuration of Support Terminal>

As illustrated in FIG. 1, the support terminal 200 includes a control device 201, a communication device 202, a display device 203, and an operation input device 204.

The support terminal 200 displays the setting target combined operation selection screen or the relative reactivity setting screen on the display device 203 by starting a predetermined application program having the same function as the above described operation screen display processing unit 301 and the combined operation setting unit 302. The support terminal 200 may set the relative reactivities of the two hydraulic actuators during the combined operation that is the target to be set, according to a setting operation on the relative reactivity setting screen using the operation input device 204, performed by the user, and transmit the set contents to the excavator 100 through the communication device 202. Accordingly, the controller 30 of the excavator 100 can control the relative reactivities of the two hydraulic actuators during the combined operation, specifically, the flow rate distribution to the two hydraulic actuators as described above, based on the set contents received from the support terminal 200. The support terminal 200 and excavator 100 may be connected via a short-range communication (for example, by a Peer to Peer (P2P), such as Bluetooth (registered trademark) communication, WiFi (registered trademark) communication, or the like) or may be communicably connected via an external device (for example, the management device 150). Hereinafter, a case where the support terminal 200 is communicably connected to the excavator 100 via the management device 150 will be described in detail.

The control device 201 performs various control processes related to the support terminal 200. The control device 201 includes an operation screen display processing unit 2011, and a setting unit 2012, as functional units that are implemented by executing one or more programs installed in the ROM or an auxiliary storage device by the CPU, for example. The control device 201 may use the storage unit 2013. The storage unit 2013 may be implemented by an auxiliary storage device provided internally in the support terminal 200, an external storage device connected externally to the support terminal 200, or the like.

The communication device 202 is connected to the external communication network that may include the mobile communication network having the base station as the terminal, the satellite communication network using the communication satellite in the sky, the Internet network, or the like, for example, and communicates with the external devices including the management device 150. The display device 203 displays various information images and GUIs under the control of the control device 201.

The operation input device 204 receives the operation input from the user of the support terminal 200, and outputs the input to the control device 201. The operation input device 204 may be a touchscreen panel implemented in the display device 203, for example.

The operation screen display processing unit 2011 displays an operation screen (that is, the setting target combined operation selection screen) for selecting the combined operation as the target to be set or the target to be checked, from among the plurality of prescribed kinds of combined operations of the excavator 100, and an operation screen (that is, the relative reactivity setting screen) for setting or checking the relative reactivities of the two hydraulic actuators during the combined operation of the excavator 100, on the display device 203. In addition, when the targets to be managed by the management device 150 include the plurality of excavators 100, the operation screen display processing unit 2011 may display the setting target combined operation selection screen and the relative reactivity setting screen, for each of the plurality of excavators 100. Moreover, as described above, when the contents of the current setting 3030 associated with the operator identification information of the current operator of the excavator 100 are uploaded from the excavator 100 to the management device 150, the operation screen display processing unit 2011 may display the setting target combined operation selection screen and the relative reactivity setting screen, for each of the plurality of operators boarding the plurality of excavators 100. In this case, the operation screen display processing unit 2011 may display an operation screen (hereinafter referred to as an "excavator and operator selection screen") for selecting a specific excavator 100 and a specific operator from among the plurality of pre-registered excavators 100 and the plurality of pre-registered operators. More particularly, the operation screen display processing unit 2011 transmits a display request for the target combined operation selection screen, the relative reactivity setting screen, the excavator and operator selection screen, or the like to the management device 150 via the communication device 202.

Accordingly, the operation screen display processing unit 2011 can display the setting target combined operation selection screen, the relative reactivity setting screen, the excavator and operator selection screen, or the like on the display device 203, based on the display resource received from the management device 150. Details thereof will be described later (refer to FIG. 3, FIG. 4A through FIG. 4D, FIG. 5, and FIG. 6).

Similar to the combined operation setting unit 302 or the like of the excavator 100, the setting portion 2012 sets the relative reactivities of the two hydraulic actuators during the combined operation that is the target to be set among the plurality of kinds of combined operations, according to the operation performed by the user through the operation input device 204 with respect to the relative reactivity setting screen. More particularly, the setting unit 2012 can set the relative reactivities of the two hydraulic actuators during the combined operation of the excavator 100, by transmitting the set request, including the set contents, input through the operation input device 204, to the management device 150 via the communication device 202. Hence, the user of the support terminal 200 can set the relative reactivities of the excavator 100 from a location external to (remote from) the excavator 100, through the management device 150. In addition, when the targets to be managed by the management device 150 include the plurality of excavators 100, the setting unit 2012 can set the relative reactivities of the two hydraulic actuators during the combined operation that is the target to be set among the plurality of kinds of combined operations, for each of the plurality of excavators 100. Moreover, as described above, when the contents of the current setting 3030 associated with the operator identification information of the current operator of the excavator 100 are uploaded from the excavator 100 to the management device 150, the setting unit 2012 can set the relative reactivities of the two hydraulic actuators during the combined operation that is the target to be set the plurality of kinds of combined operations, for each of the plurality of operators boarding the plurality of excavators 100.

Similar to the storage unit 303 or the like of the excavator 100, the storage unit 2013 stores the contents of the current setting of the relative reactivities of the two hydraulic actuators during the combined operation of the excavator 100, the contents of the initial setting, the contents of the reference setting, and the contents of the customized setting registered according to the user preference. These contents may be downloaded from the management device 150 to the support terminal 200.

[Example of Relative Reactivity Setting Screen]

Next, a specific example of the relative reactivity setting screen will be described with reference to FIG. 3, FIG. 4 (FIG. 4A through FIG. 4D), FIG. 5, and FIG. 6.

Figure 3:
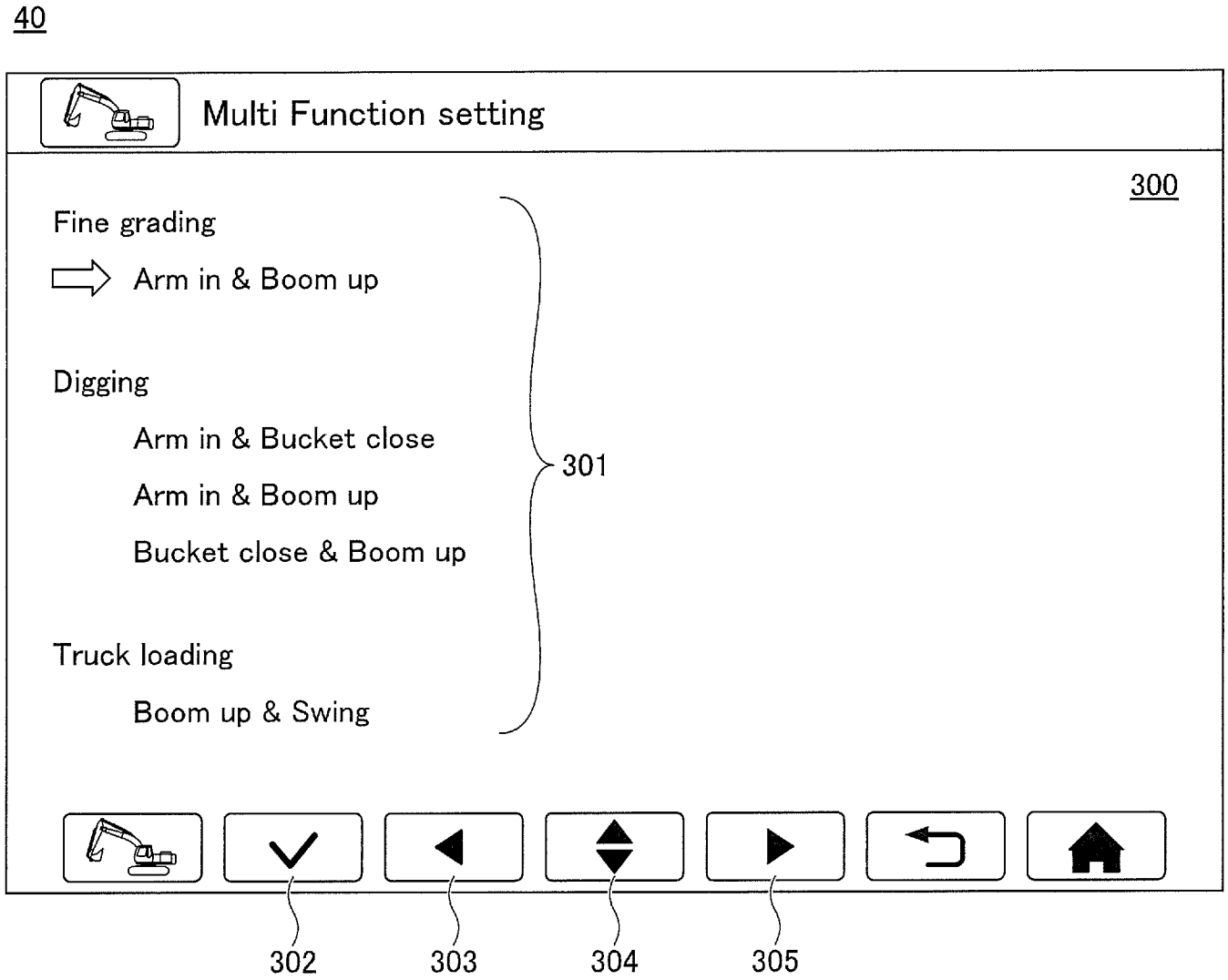
FIG. 3 is a diagram illustrating an example of a setting target combined operation selection screen.

FIG. 3 is a diagram illustrating an example (a setting target combined operation selection screen 300) of a selection screen (setting target combined operation selection screen) for selecting the kind of combined operation or multi function setting, having the relative reactivities set by the relative reactivity setting screen, that is the target to be set from among the plurality of kinds of prescribed combined operations, displayed on the display device 40 of the excavator 100. As described above, the operation screen similar to the setting target combined operation selection screen 300 may also be displayed on the display device 153 of the management device 150, and the display device 203 of the support terminal 200. Hereinafter, the same applies to relative reactivity setting screens 400 through 430 of FIG. 4A through FIG. 4D and a registration content call screen 500 of FIG. 5.

For example, when an option (for example, a button icon) for a predetermined screen transition, displayed on a predetermined operation screen (for example, a so-called home screen) displayed on the display device 40 is operated through the operation input device 42, the operation screen display processing unit 301 may cause the display contents of the display device 40 to make a transition to the setting target combined operation selection screen 300. In addition, the operation screen display processing unit 301 may cause the display contents of the display device 40 to make the transition to the setting target combined operation selection screen 300, according to the user operation with respect to the registration content call screen for utilizing the registration contents, such as the initial setting 3031, the reference setting 3032, and the customized setting 3033, for example, as will be described later.

As illustrated in FIG. 3, the setting target combined operation selection screen 300 includes a list 304 of the plurality of kinds of selectable combined operations, arranged at a center portion along an up-and-down direction. In addition, the setting target combined operation selection screen 300 includes button icons 305 through 308 for performing a cursor operation, arranged at a lower end portion along a left-to-right direction.

The list 304 includes a combined operation (hereinafter referred to as an "arm in & boom up") that is a combination of an arm in operation of the arm 5 (hereinafter referred to as an "arm in") and a boom up operation during a fine grading ("fine grading"), as the kind of selectable combined operation. In addition, the list 304 includes a combined operation (hereinafter referred to as an "arm in & bucket close") that is a combination of the arm in operation and the bucket close operation of the bucket 6 (hereinafter referred to as "bucket close") during a digging ("digging"), as the kind of selectable combined operation. Moreover, the list 304 includes an arm in and boom up operation during the digging, as the kind of selectable combined operation. Further, the list 304 includes a combined operation (hereinafter referred to as a "bucket close & boom up") that is a combination of the bucket close operation and the boom up operation during the digging, as the kind of selectable combined operation. The list 304 also includes a boom up and swing ("boom up & swing") that is a combination of the boom up operation and the swing operation during a loading of sediment or the like to a truck ("truck loading"), as the kind of selectable combined operation.

In this example, the relative reactivities of the arm cylinder 8 and the boom cylinder 7 may be set differently between the arm in and boom up operation during the fine grading, and the arm in and boom up operation during the digging. In this case, the controller 30 determines the operation contents of the excavator 100, and controls the flow rate distribution to the arm cylinder 8 and the boom cylinder 7 based on the current setting 3030 corresponding to the operation contents, according to whether the determined operation contents relate to the fine grading or the digging. More particularly, the controller 30 may determine whether the operation contents relate to the fine grading or the digging, according to a measured value the cylinder pressure of the boom cylinder 7, an image in front of the excavator 100 captured by the camera, or the like, for example. In addition, the controller 30 may determine whether the operation contents relate to the fine grading or the digging, according to the user operation of a switch or the like for selecting a type of operation, included in the operation input device 42.

The user can move the cursor up and down (for example, a color of a name of the selectable kind of combined operation changes to a different color, or an arrow is displayed) and select the desired kind of combined operation, by operating the button icon 307 through the operation input device 42. The user can then confirm and enter the selected kind of combined operation by operating the button icon 305 through the operation input device 42, in a state where the desired kind of combined operation selected by the cursor.

When the kind of combined operation is confirmed and entered, the operation screen display processing unit 301 causes the display contents of the display device 40 to make a transition to the relative reactivity setting screen (for example, relative reactivity setting screens 400 through 430 that will be described later) for the kind of combined operation whose selection is confirmed and entered.

A touchscreen panel implemented in the display device 40 may be used in place of the cursor, to select various items. Hereinafter, the same applies to the relative reactivity setting screens of FIG. 4A through FIG. 4D and the registration content call screen of FIG. 5.

FIG. 4A through FIG. 4D are diagrams illustrating specific examples of the relative reactivity setting screens.

Figure 4A:
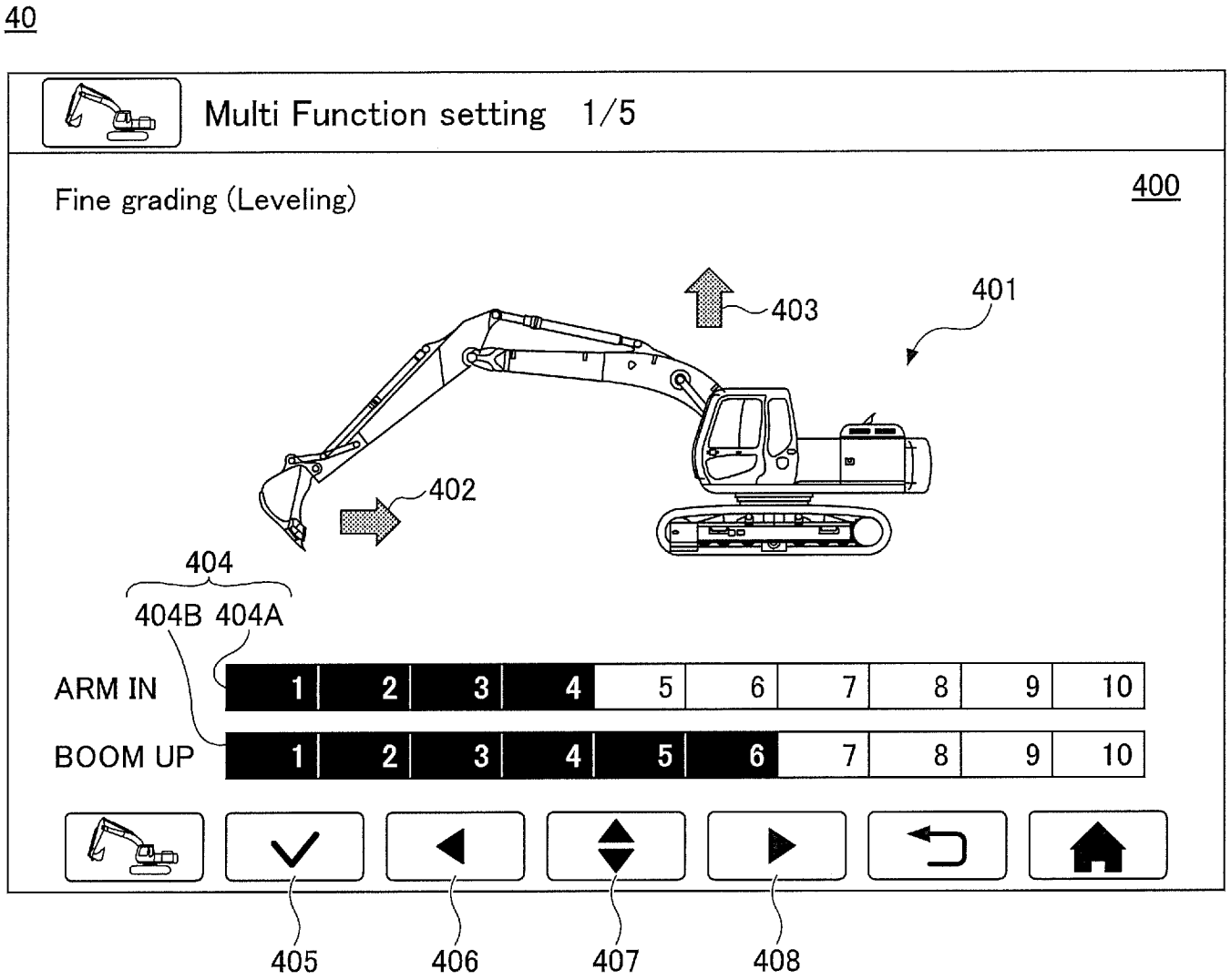
FIG. 4A is a diagram illustrating a first example of a relative reactivity setting screen.

First, FIG. 4A is a diagram illustrating a first example (relative reactivity setting screen 400) of the relative reactivity setting screen. More particularly, FIG. 4A is a diagram illustrating the example of the relative reactivity setting screen (relative reactivity setting screen 400) for the arm in and boom up operation during the fine grading.

As illustrated in FIG. 4A, the relative reactivity setting screen 400 includes an image (hereinafter referred to as an "excavator image") 401 of the excavator 100, resembling the kind of combined operation (arm in and boom up operation during the fine grading) that is the target to be set, arranged at the center portion thereof. In addition, the relative reactivity setting screen 400 includes arrow icons 402 and 403, resembling the arm in operation and the boom up operation, respectively arranged adjacent to portions corresponding to the arm 5 and the boom 4 of the excavator image 401. Moreover, the relative reactivity setting screen 400 includes a bar graph 404 indicating the relative reactivities of the arm cylinder 8 and the boom cylinder 7, arranged below the excavator image 401. Further, the relative reactivity setting screen 400 includes button icons 405 through 408 for performing the cursor operation, arranged in the left-to-right direction at the lower end thereof, similar to the setting target combined operation selection screen 300.

The bar graph 404 includes a bar graph 404A indicating the relative reactivity of the arm cylinder 8 corresponding to the arm in operation, and a bar graph 404B indicating the relative reactivity of the boom cylinder 7 corresponding to the boom up operation. The bar graphs 404A and 404B are arranged one on top of the other, and extend in the left-to-right direction across the relative reactivity setting screen 400.

In this example, the bar graphs 404A and 404B respectively employ a 10-level indication. The bar graphs 404A and 404B are respectively displayed in a range of "level 1" to "level 9", so that a sum of the two levels adds up to "level 10". In the state illustrated in FIG. 4A, the bar graph 404A indicates the "level 4", and the bar graph 404B indicates the "level 6", to indicate the state where the operation of the boom cylinder 7 has slight precedence over the operation of the arm cylinder 8. Hence, the user can visually (intuitively) and easily check the relative reactivities of the two hydraulic actuators (arm cylinder 8 and boom cylinder 7), thus enabling the relative reactivities to be set with ease.

For example, the user may select one of the bar graphs 404A and 404B by operating the button icon 407 through the operation input device 42 to move the cursor up and down (for example, the characters "ARM IN" and "BOOM UP" accompanying the bar graphs 404A and 404B change to different colors). Then, in the state where one of the bar graphs 404A and 404B is selected, the user can increase the level of the selected bar graph, one level at a time by operating the button icon 408 through the operation input device 42, and reduce the level of the selected bar graph one level at a time by operating the button icon 406 through the operation input device 42. In this state, the operation screen display processing unit 301 automatically decreases or increases the level of the other non-selected bar graph according to the increase or decrease in the level of the selected bar graph, and maintains the state where the sum of the two levels is the "level 10". Hence, the controller 30 can improve the user's convenience, since the user does not need to perform an operation to change the level of the other non-selected bar graph.

The operation screen display processing unit 301 may change the display of one bar graph to the level position where the touch operation or the like is performed, and change the display of the other bar graph so that the sum of the level thereof and the level of the one bar graph after the change becomes the "level 10", according to the touch operation or the like to the level position of one of the bar graphs 404A and 404B through the touchscreen panel or the like as the operation input device 42. In this case, the controller 30 and further improve the user's convenience, since the user can directly set the levels of the bar graphs 404A and 404B through the touchscreen panel.

Further, according to an operation (for example, a touch operation or the like) with respect to one of the arrow icons 402 and 403 through the touchscreen panel or the like as the operation input device 42, the operation screen display processing unit 301 may increase the level of the corresponding one of the bar graphs 404A and 404B and reduce the level of the other bar graph. In this case, the user can intuitively check with ease whether the operation is the arm in operation or the boom up operation, by the arrow icons 402 and 403 accompanying the excavator image 401. Therefore, the controller 30 can further improve the user's convenience, since it is possible to change the setting of the relative reactivities while checking the operation that is to have precedence.

In addition, the operation screen display processing unit 301 may increase the level of one of the bar graphs 404A and 404B and reduce the level of the other bar graph, according to an operation (for example, a touch operation or the like) with respect to a portion of the operation elements (that is, the arm 5 or the boom 4) driven by the two hydraulic actuators corresponding to the combined operation that is the target to be set in the excavator image 401, through the touchscreen panel or the like as the operation input device 42. In this case, the user can intuitively check from the excavator image 401, with ease, whether the operation is the arm in operation or the boom up operation. For this reason, the controller 30 can further improve the user's convenience, because similar to the case where the operation is performed with respect to the arrow icons 402 and 403, it is possible to change the setting of the relative reactivities while checking the operation that is to have precedence.

Moreover, the size of the corresponding arrow icons 402 and 403 may change according to the change in the level of bar graphs 404A and 404B. More particularly, the operation screen display processing unit 301 may increase the size of the arrow icon 402 corresponding to the arm in operation as the level of the bar graph 404A corresponding to the arm in operation increases, and reduce the size of the arrow icon 402 as the level of the bar graph 404A decreases. Further, the operation screen display processing unit 301 may increase the size of the arrow icon 403 corresponding to the boom up operation as the level of the bar graph 404B corresponding to the boom up operation increases, and reduce the size of the arrow icon 403 as the level of the bar graph 404B decreases. In this case, the user can visually check, with ease, the relationship of the relative reactivities of the two hydraulic actuators, and more easily change the setting of the relative reactivities.

In a state where the levels of the bar graphs 404A and 404B are changed to the desired contents, the user can operate the button icon 405 through the operation input device 42, and confirm and enter the relative reactivities of the arm cylinder 8 and the boom cylinder 7 corresponding to the display contents of the bar graphs 404A and 404B. In this state, the combined operation setting unit 302 stores the relative reactivities of the arm cylinder 8 and the boom cylinder 7 when performing the arm in and boom up operation during the fine grading, corresponding to the display contents of the bar graphs 404A and 404B, in the storage unit 303 as the current setting 3030.

Figure 4B:
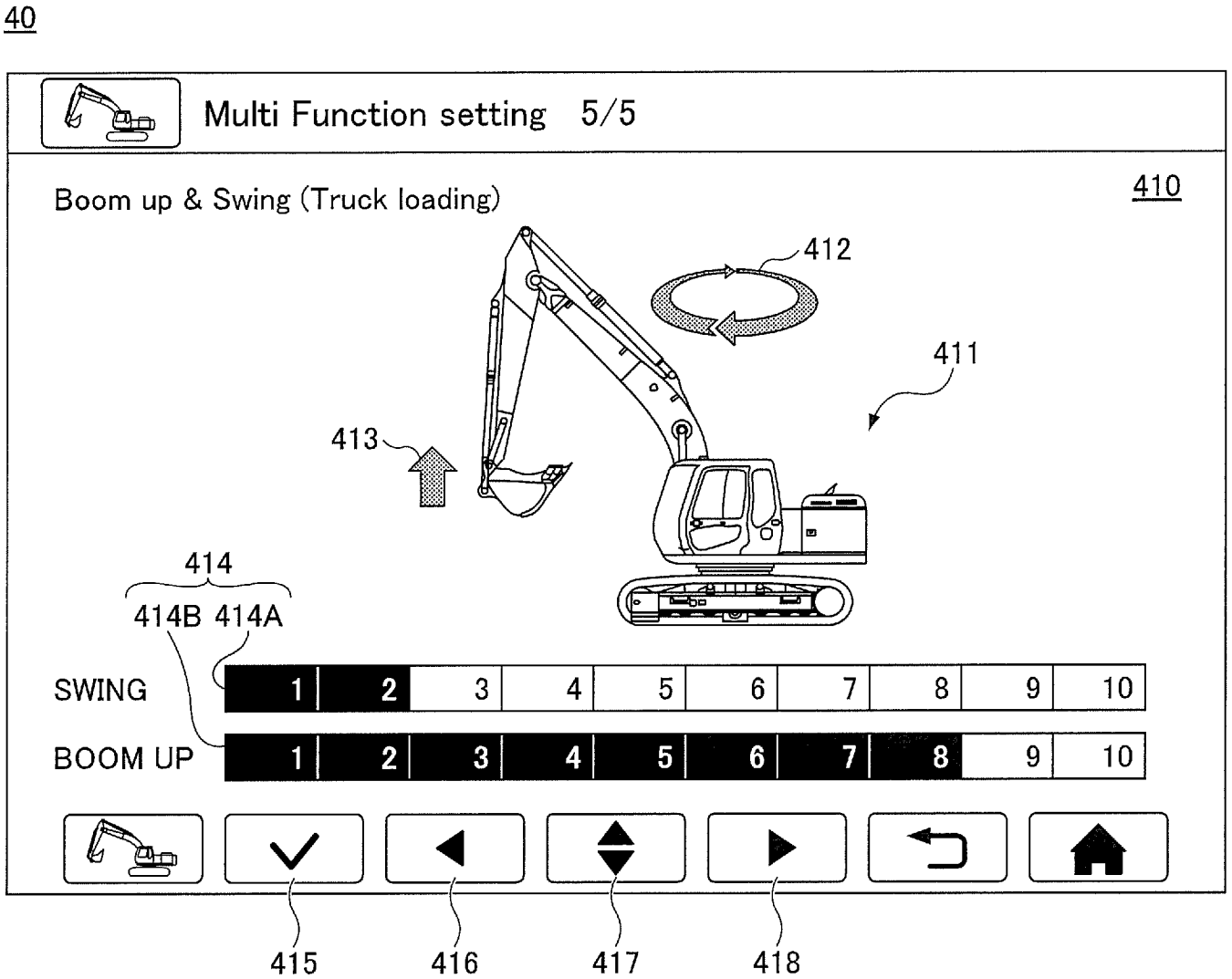
FIG. 4B is a diagram illustrating a second example of the relative reactivity setting screen.

Next, FIG. 4B is a diagram illustrating a second example (relative reactivity setting screen 410) of the relative reactivity setting screen. More particularly, FIG. 4B is a diagram illustrating the example of the relative reactivity setting screen (relative reactivity setting screen 410) for the boom up and swing operation during the truck loading that loads the sediment or the like to the truck.

As illustrated in FIG. 4B, the relative reactivity setting screen 410 includes an excavator image 411 resembling the kind of combined operation (boom up and swing operation during the truck loading) that is the target to be set, arranged at the center portion thereof, similar to the case illustrated in FIG. 4A. In addition, the relative reactivity setting screen 410 includes arrow icons 412 and 413, resembling the swing operation and the boom up operation, respectively arranged at positions adjacent to the excavator image 411, similar to the case illustrated in FIG. 4A. Moreover, the relative reactivity setting screen 410 includes a bar graph 414 indicating the relative reactivities of the boom cylinder 7 and the swing hydraulic motor 2A, arranged below the excavator image 411, similar to the case illustrated in FIG. 4A. Further, the relative reactivity setting screen 410 includes button icons 415 through 418 for performing the cursor operation, arranged in the left-to-right direction at the lower end thereof, similar to the case illustrated in FIG. 4A.

In this example, bar graphs 414A and 414B respectively employ the 10-level indication, similar to the case illustrated in FIG. 4A. The bar graphs 414A and 414B are respectively displayed in a range of "level 1" to "level 9", so that a sum of the two levels adds up to "level 10". In the state illustrated in FIG. 4B, the bar graph 414A indicates the "level 2", and the bar graph 414B indicates the "level 8", to indicate the state where the operation of the boom cylinder 7 has slight precedence over the operation of the swing hydraulic motor 2A.

For example, similar to the case illustrated in FIG. 4A, the user may select one of the bar graphs 414A and 414B by operating the button icon 417 through the operation input device 42 to move the cursor up and down (for example, the characters "SWING" and "BOOM UP" accompanying the bar graphs 414A and 414B change to different colors). Then, in the state where one of the bar graphs 414A and 414B is selected, the user can increase the level of the selected bar graph, one level at a time by operating the button icon 418 through the operation input device 42, and reduce the level of the selected bar graph one level at a time by operating the button icon 416 through the operation input device 42. In this state, similar to the case illustrated in FIG. 4A, the operation screen display processing unit 301 automatically decreases or increases the level of the other non-selected bar graph according to the increase or decrease in the level of the selected bar graph, and maintains the state where the sum of the two levels is the "level 10".

In addition, similar to the case illustrated in FIG. 4A, the operation screen display processing unit 301 may change the display of one bar graph to the level position where the touch operation or the like is performed, and change the display of the other bar graph so that the sum of the level thereof and the level of the one bar graph after the change becomes the "level 10", according to the touch operation or the like to the level position of one of the bar graphs 414A and 414B through the touchscreen panel or the like as the operation input device 42.

Moreover, similar to the case illustrated in FIG. 4A, according to an operation (for example, a touch operation or the like) with respect to one of the arrow icons 412 and 413 through the touchscreen panel or the like as the operation input device 42, the operation screen display processing unit 301 may increase the level of the corresponding one of the bar graphs 414A and 414B and reduce the level of the other bar graph.

Further, similar to the case illustrated in FIG. 4A, the operation screen display processing unit 301 may increase the level of one of the bar graphs 414A and 414B and reduce the level of the other bar graph, according to an operation (for example, a touch operation or the like) with respect to a portion of the operation elements (that is, the slewing upper structure 3 or the boom 4) driven by the two hydraulic actuators corresponding to the combined operation that is the target to be set in the excavator image 411, through the touchscreen panel or the like as the operation input device 42.

In addition, similar to the case illustrated in FIG. 4A, the size of the corresponding arrow icons 412 and 413 may change according to the change in the level of bar graphs 414A and 414B. More particularly, the operation screen display processing unit 301 may increase the size of the arrow icon 412 corresponding to the swing operation as the level of the bar graph 414A corresponding to the swing operation increases, and reduce the size of the arrow icon 412 as the level of the bar graph 414A decreases. Further, the operation screen display processing unit 301 may increase the size of the arrow icon 413 corresponding to the boom up operation as the level of the bar graph 414B corresponding to the boom up operation increases, and reduce the size of the arrow icon 413 as the level of the bar graph 414B decreases.

Moreover, similar to the case illustrated in FIG. 4A, in a state where the levels of the bar graphs 414A and 414B are changed to the desired contents, the user can operate the button icon 415 through the operation input device 42, and confirm and enter the relative reactivities of the swing hydraulic motor 2A and the boom cylinder 7 corresponding to the display contents of the bar graphs 414A and 414B. In this state, the combined operation setting unit 302 stores the relative reactivities of the swing hydraulic motor 2A and the boom cylinder 7 when performing the boom up and swing operation during the truck loading, corresponding to the display contents of the bar graphs 414A and 414B, in the storage unit 303 as the current setting 3030.

Figure 4C:
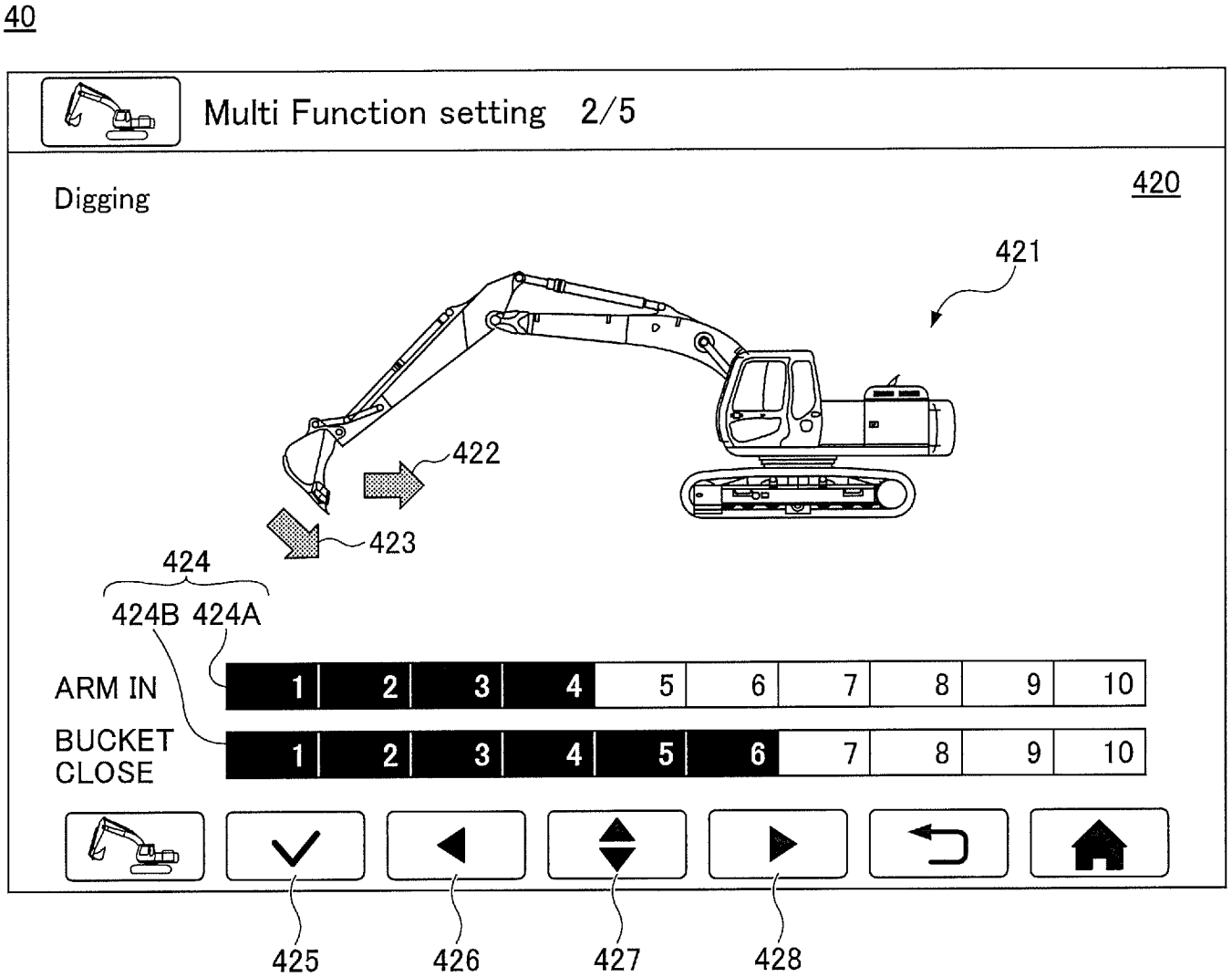
FIG. 4C is a diagram illustrating a third example of the relative reactivity setting screen.

Next, FIG. 4C is a diagram illustrating a third example (relative reactivity setting screen 420) of the relative reactivity setting screen. More particularly, FIG. 4C is a diagram illustrating the example of the relative reactivity setting screen (relative reactivity setting screen 420) for the am in and bucket close operation during the digging.

As illustrated in FIG. 4C, the relative reactivity setting screen 420 includes an excavator image 421 resembling the kind of combined operation (arm in and bucket close operation during the digging) that is the target to be set, arranged at the center portion thereof, similar to the case illustrated in FIG. 4A. In addition, the relative reactivity setting screen 420 includes arrow icons 422 and 423, resembling the atm in operation and the bucket close operation, respectively arranged at positions adjacent to the excavator image 421, similar to the case illustrated in FIG. 4A. Moreover, the relative reactivity setting screen 420 includes a bar graph 424 indicating the relative reactivities of the arm cylinder 8 and the bucket cylinder 9, arranged below the excavator image 421, similar to the case illustrated in FIG. 4A. Further, the relative reactivity setting screen 420 includes button icons 425 through 428 for performing the cursor operation, arranged in the left-to-right direction at the lower end thereof, similar to the case illustrated in FIG. 4A.

In this example, bar graphs 424A and 424B respectively employ the 10-level indication, similar to the case illustrated in FIG. 4A. The bar graphs 424A and 424B are respectively displayed in a range of "level 1" to "level 9", so that a sum of the two levels adds up to "level 10". In the state illustrated in FIG. 4C, the bar graph 424A indicates the "level 4", and the bar graph 424B indicates the "level 6", to indicate the state where the operation of the bucket cylinder 9 has slight precedence over the operation of the arm cylinder 8.

For example, similar to the case illustrated in FIG. 4A, the user may select one of the bar graphs 424A and 424B by operating the button icon 427 through the operation input device 42 to move the cursor up and down (for example, the characters "ARM IN" and "BUCKET CLOSE" accompanying the bar graphs 424A and 424B change to different colors). Then, in the state where one of the bar graphs 424A and 424B is selected, the user can increase the level of the selected bar graph, one level at a time by operating the button icon 428 through the operation input device 42, and reduce the level of the selected bar graph one level at a time by operating the button icon 426 through the operation input device 42. In this state, similar to the case illustrated in FIG. 4A, the operation screen display processing unit 301 automatically decreases or increases the level of the other non-selected bar graph according to the increase or decrease in the level of the selected bar graph, and maintains the state where the sum of the two levels is the "level 10".

In addition, similar to the case illustrated in FIG. 4A, the operation screen display processing unit 301 may change the display of one bar graph to the level position where the touch operation or the like is performed, and change the display of the other bar graph so that the sum of the level thereof and the level of the one bar graph after the change becomes the "level 10", according to the touch operation or the like to the level position of one of the bar graphs 424A and 424B through the touchscreen panel or the like as the operation input device 42.

Moreover, similar to the case illustrated in FIG. 4A, according to an operation (for example, a touch operation or the like) with respect to one of the arrow icons 422 and 423 through the touchscreen panel or the like as the operation input device 42, the operation screen display processing unit 301 may increase the level of the corresponding one of the bar graphs 424A and 424B and reduce the level of the other bar graph.

Further, similar to the case illustrated in FIG. 4A, the operation screen display processing unit 301 may increase the level of one of the bar graphs 424A and 424B and reduce the level of the other bar graph, according to an operation (for example, a touch operation or the like) with respect to a portion of the operation elements (that is, the arm 5 or the bucket 6) driven by the two hydraulic actuators corresponding to the combined operation that is the target to be set in the excavator image 421, through the touchscreen panel or the like as the operation input device 42.

In addition, similar to the case illustrated in FIG. 4A, the size of the corresponding arrow icons 422 and 423 may change according to the change in the level of bar graphs 424A and 424B. More particularly, the operation screen display processing unit 301 may increase the size of the arrow icon 422 corresponding to the arm in operation as the level of the bar graph 424A corresponding to the arm in operation increases, and reduce the size of the arrow icon 422 as the level of the bar graph 424A decreases. Further, the operation screen display processing unit 301 may increase the size of the arrow icon 423 corresponding to the bucket close operation as the level of the bar graph 424B corresponding to the bucket close operation increases, and reduce the size of the arrow icon 423 as the level of the bar graph 424B decreases.

Moreover, similar to the case illustrated in FIG. 4A, in a state where the levels of the bar graphs 424A and 424B are changed to the desired contents, the user can operate the button icon 425 through the operation input device 42, and confirm and enter the relative reactivities of the arm cylinder 8 and the bucket cylinder 9 corresponding to the display contents of the bar graphs 424A and 424B. In this state, the combined operation setting unit 302 stores the relative reactivities of the arm cylinder 8 and the bucket cylinder 9 when performing the arm in and bucket close operation during the digging, corresponding to the display contents of the bar graphs 424A and 424B, in the storage unit 303 as the current setting 3030.

In addition, the relative reactivity setting screens related to the arm in boom up operation and the bucket close and boom up operation during the drilling illustrated in FIG. 3 described above, may be similar to the screens illustrated in FIG. 4A through FIG. 4C.

Figure 4D:
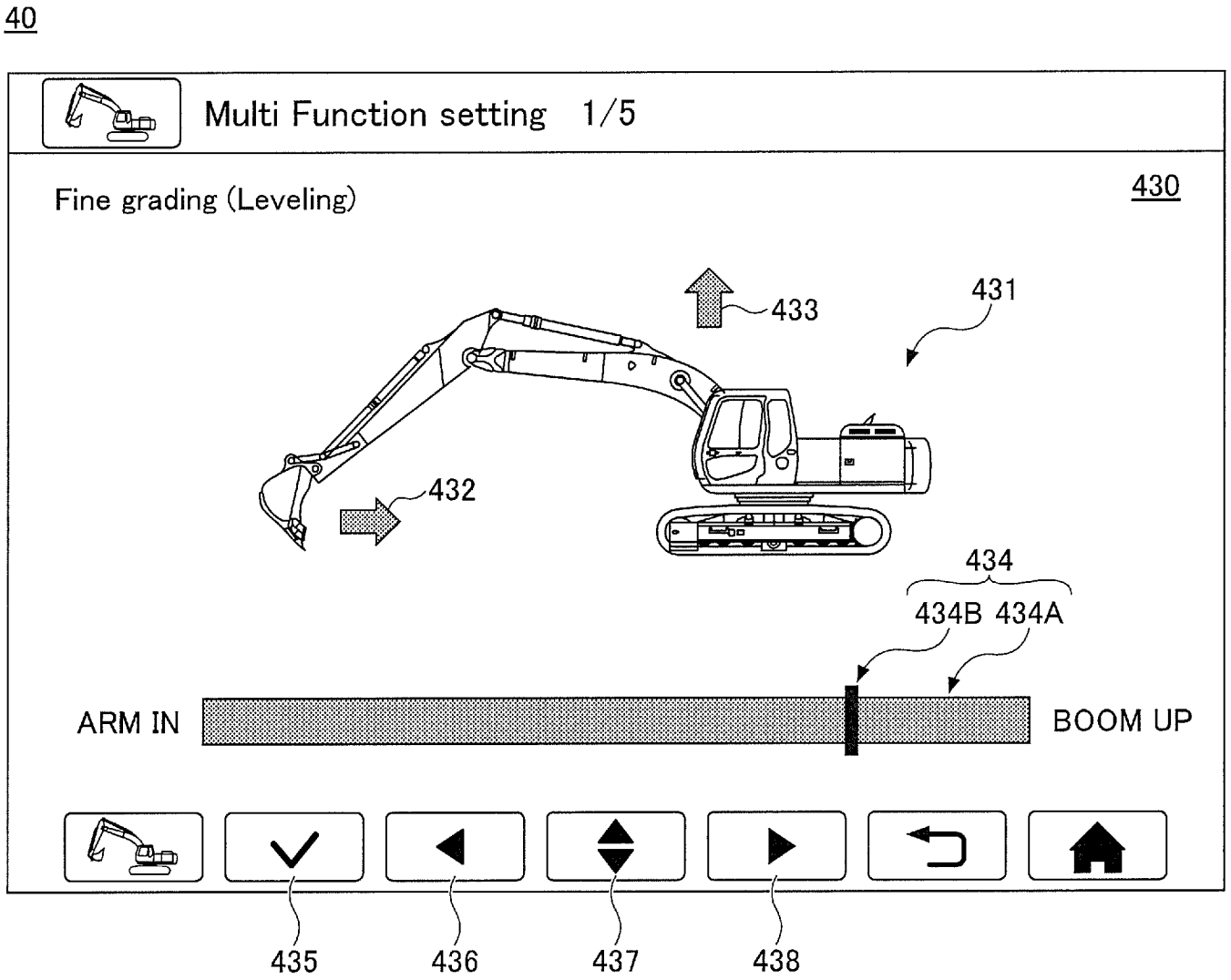
FIG. 4D is a diagram illustrating a fourth example of the relative reactivity setting screen.

Next, FIG. 4D is a diagram illustrating a fourth example (relative reactivity setting screen 430) of the relative reactivity setting screen. More particularly, FIG. 4D is a diagram illustrating the example of the relative reactivity setting screen (relative reactivity setting screen 430) for an arm in and boom up during the fine grading.

As illustrated in FIG. 4D, the relative reactivity setting screen 430 includes an excavator image 431 resembling the kind of combined operation (arm in and boom up operation during the fine grading) that is the target to be set, arranged at the center portion thereof, similar to the case illustrated in FIG. 4A. In addition, the relative reactivity setting screen 430 includes arrow icons 432 and 433, resembling the arm in operation and the boom up operation, respectively arranged at positions adjacent to the excavator image 431, similar to the case illustrated in FIG. 4A. Moreover, the relative reactivity setting screen 430 includes a bar graph 434 indicating the relative reactivities of the arm cylinder 8 and the boom cylinder 7, arranged below the excavator image 431, similar to the case illustrated in FIG. 4A. Further, the relative reactivity setting screen 430 includes button icons 435 through 438 for performing the cursor operation, arranged in the left-to-right direction at the lower end thereof, similar to the case illustrated in FIG. 4A.

Unlike the case illustrated in FIG. 4A, the bar graph 434 includes a single bar 434A, and a scale icon 434B that is slidable to the left and right on the bar 434A. In this example, the bar graph 434A extends in the left-to-right direction across the relative reactivity setting screen 430, and characters "ARM IN" and "BOOM UP" corresponding to the arm in operation and the boom up operation accompany to the left end and the right end of the bar 434A, respectively. In addition, a length of a portion of the bar 434A to the left side of the scale icon 434B indicates the relative reactivity of the arm cylinder 8, and a length of a portion of the bar 434A to the right side of the scale icon 434B indicates the relative reactivity of the arm cylinder 8. Accordingly, since the user can visually check the relative reactivities of the two hydraulic actuators (arm cylinder 8 and bucket cylinder 9) with ease according to the left-to-right position of the scale icon 434B on the bar 434A, it is possible to easily set the relative reactivities.

For example, the user may move the cursor (for example, change the color of the scale icon 434B) up or down by operating the button icon 437 through the operation input device 42, to select the scale icon 434B. Then, in the state where the scale icon 434B is selected, the user can decrease in steps the relative reactivity of the arm cylinder 8 corresponding to the arm in operation, and increase in steps the relative reactivity of the boom cylinder 7 corresponding to the boom up operation, by operating the button icon 436 through the operation input device 42. In addition, in the state where the scale icon 434B is selected, the user can increase in steps the relative reactivity of the arm cylinder 8 corresponding to the arm in operation, and decrease in steps the relative reactivity of the boom cylinder 7 corresponding to the boom up operation, by operating the button icon 438 through the operation input device 42. The relative reactivity of each of the arm cylinder 8 and the boom cylinder 7 may be increased or decreased, by a direct operation (for example, a sliding operation) performed by the user with respect to the scale icon 434B through the touchscreen panel or the like as the operation input device 42.

In addition, similar to the case illustrated in FIG. 4A or the like, the operation screen display processing unit 301 may change in steps the left-to-right position of the scale icon 434B according to the operation (for example, a touch operation or the like) performed on either one of the arrow icons 432 and 433 through the touchscreen panel or the like as the operation input device 42. More particularly, the operation screen display processing unit 301 may move in steps the scale icon 434B to the right in order to increase the relative reactivity of the corresponding arm cylinder 8 when the arrow icon 432 is operated, and move in steps the scale icon 434B to the left in order to increase the relative reactivity of the corresponding boom cylinder 7 when the arrow icon 433 is operated.

Further, similar to the case illustrated in FIG. 4A or the like, the operation screen display processing unit 301 may change in steps the left-to-right position of the scale icon 434B, according to an operation (for example, a touch operation or the like) with respect to a portion of the operation elements (that is, the arm 5 or the boom 4) driven by the two hydraulic actuators corresponding to the combined operation that is the target to be set in the excavator image 431, through the touchscreen panel or the like as the operation input device 42. More particularly, the operation screen display processing unit 301 may move in steps the scale icon 434B to the right, in order to increase the relative reactivity of the corresponding arm cylinder 8 when an operation is performed on the portion of the excavator image 431 corresponding to the arm 5, and move in steps the scale icon 434B to the left, in order to increase the relative reactivity of the corresponding boom cylinder 7 when an operation is performed on the portion of the excavator 431 corresponding to the boom 4.

In addition, similar to the case illustrated in FIG. 4A or the like, the size of the corresponding arrow icons 432 and 433 may change according to the change in the left-to-right position of the scale icon 434B. More particularly, the operation screen display processing unit 301 may increase the size of the arrow icon 432 and reduce the size of the arrow icon 433 as the position of the scale icon 434B changes toward the right. Further, the operation screen display processing unit 301 may reduce the size of the arrow icon 432 and increase the size of the arrow icon 433 as the position of the scale icon 434B changes toward the left.

Moreover, in a state where the left-to-right position of the scale icon 434B of the bar graph 434 is changed to that of the desired contents, the user can operate the button icon 435 through the operation input device 42, and confirm and enter the relative reactivities of the arm cylinder 8 and the boom cylinder 7 corresponding to the display contents of the bar graph 434 (scale icon 434B). In this state, similar to the case illustrated in FIG. 4A or the like, the combined operation setting unit 302 stores the relative reactivities of the arm cylinder 8 and the boom cylinder 7 when performing the arm in and boom up operation during the fine grading, corresponding to the display contents of the bar graph 434 (scale icon 434B), in the storage unit 303 as the current setting 3030.

In addition, the relative reactivity setting screens related to the arm in bucket close operation, the arm in boom up operation, and the bucket close and boom up operation during the drilling illustrated in FIG. 3 described above, and the relative reactivity setting screen related to the boom up and swing operation during the truck loading illustrated in FIG. 3 described above, may be similar to the screen illustrated in FIG. 4D.

Figure 5:
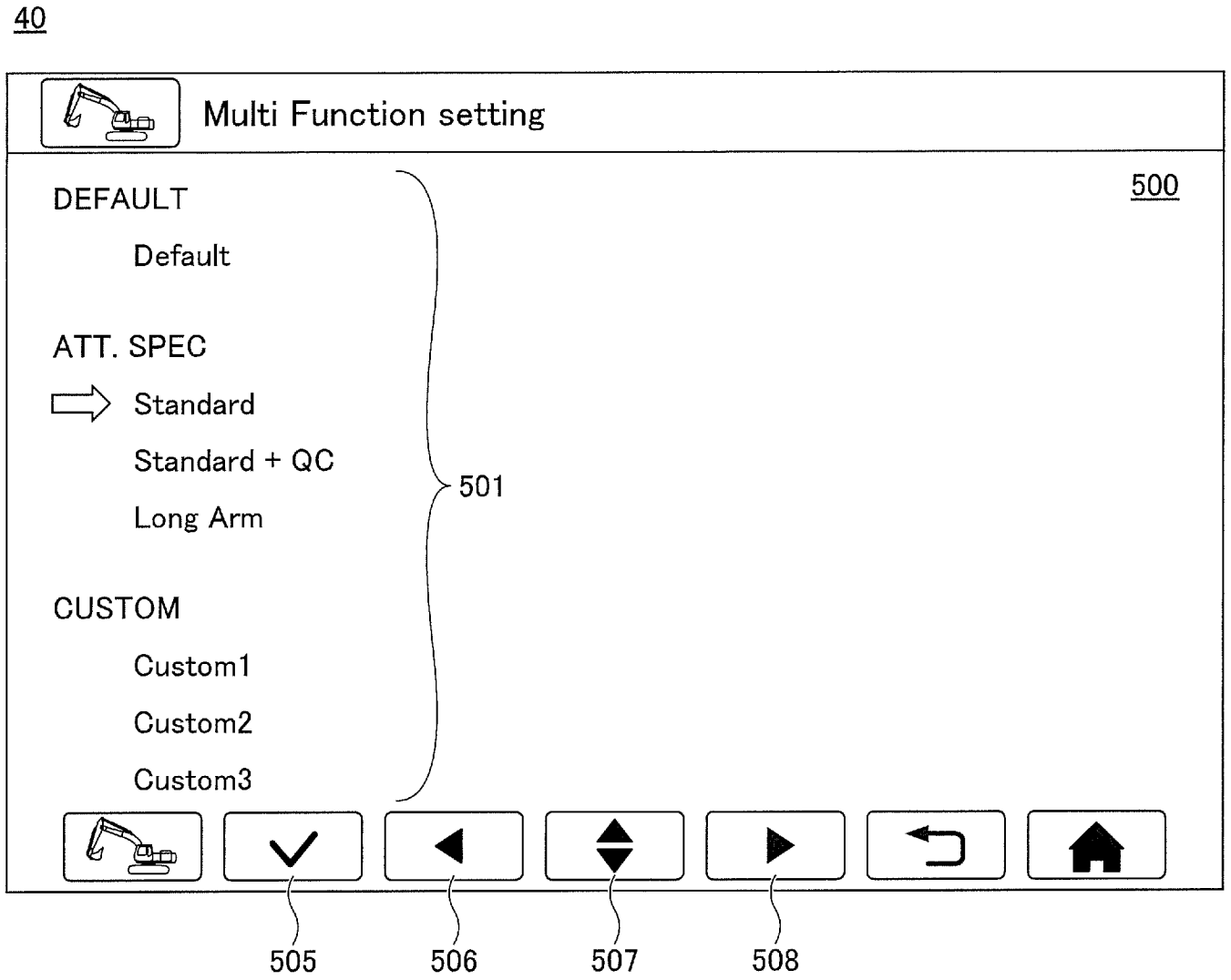
FIG. 5 is a diagram illustrating an example of a registration content call screen.

FIG. 5 illustrates an example (a registration content call screen 500) of an operation screen (hereinafter referred to as a "registration content call screen") for calling the contents registered in the storage unit 303, such as the initial setting 3031, the reference setting 3032, and the customized setting 3033, and performing the relative reactivity setting.

For example, when an option (for example, a button icon) for a predetermined screen transition, displayed on a predetermined operation screen (for example, a home screen) displayed on the display device 40 is operated through the operation input device 42, the operation screen display processing unit 301 may cause the display contents of the display device 40 to make a transition to the registration content call screen 500.

As illustrated in FIG. 5, the registration content call screen 500 includes a list 501 of callable registration contents, arranged at the center portion along the up-and-down direction. In addition, the registration content call screen 500 includes button icons 505 through 508 for performing a cursor operation, arranged at the lower end portion along the left-to-right direction, similar to the setting target combined operation selection screen 300, the relative reactivity setting screens 400 through 430, or the like.

The list 501 includes an initial setting ("DEFAULT") of the relative reactivities ("Default"), as the callable registration contents that can be called from the storage unit 303. In addition, the list 501 includes a reference setting ("ATT-.SPEC") for each of a plurality of accessory specifications related to the attachments applicable to the excavator 100, as the callable registration contents that can be called from the storage unit 303. More particularly, the list 501 includes standard specifications ("Standard"), quick coupling specifications ("Standard+QC"), and long arm specifications ("Long Arm") of the attachments. Further, the list 501 includes a customized setting ("CUSTOM") registered by the user, as the callable registration contents that can be called from the storage unit 303. In this example, three kinds of customized settings can be registered, and the list 501 includes three kinds of customized settings ("Custom1" through "Custom3").

The user can move the cursor up and down (for example, the color of the callable registration contents changes to a different color, or an arrow is displayed) and select the desired registration contents by operating the button icon 507 through the operation input device 42. In the state where the desired registration contents are selected by the cursor, the user can confirm and enter the selected registration contents as a calling target, by operating the button icon 505 through the operation input device 42.

When the kind of the calling registration contents is confirmed and entered, the operation screen display processing unit 301 causes the display contents of the display device 40 to make a transition to the setting target combined operation selection screen in a state where the kind of the registration contents is stored. As described above, when the combined operation that is the target to be set is confirmed and entered according to the operation performed by the user through the operation input device 42, the operation screen display processing unit 301 calls (reads) the stored kind of registration contents from the storage unit 303, and causes the display contents of the display device 40 to make a transition to the relative reactivity setting screen that reflects the registration contents. Accordingly, by performing a confirm and enter operation through the operation input device 42 on the relative reactivity setting screen in which the registration contents (the initial setting 3031, the reference setting 3032, and the customized setting 3033) selected by the user are reflected, the user can set the relative reactivities to the registration contents selected on the registration content call screen.

In the case of customized setting, there is a possibility that the registration is not performed with respect to all of the kinds of combined operations that are the targets to be set. For this reason, in a case where the contents with respect to only one kind of combined operation are registered in a certain kind of the customized setting, for example, when the customized setting is the target to be called, the operation screen display processing unit 301 may not cause the display contents of the display device 40 to make a transition to the setting combined operation selection screen, and instead cause a transition directly to the relative reactivity setting screen related to the corresponding kind of combined operation. Further, in a case where the contents with respect to only some of the kinds of combined operations, among the kinds of combined operations that are the targets to be set, are registered for a certain kind of customized setting, for example, and this customized setting is the target to be called, the operation screen display processing unit 301 may make no display of the kind of combined operation not registered as the customized setting, or make a display of the kind of combined operation not registered as the customized setting in an operation disabled state, on the setting target combined operation selection screen.

Figure 6:
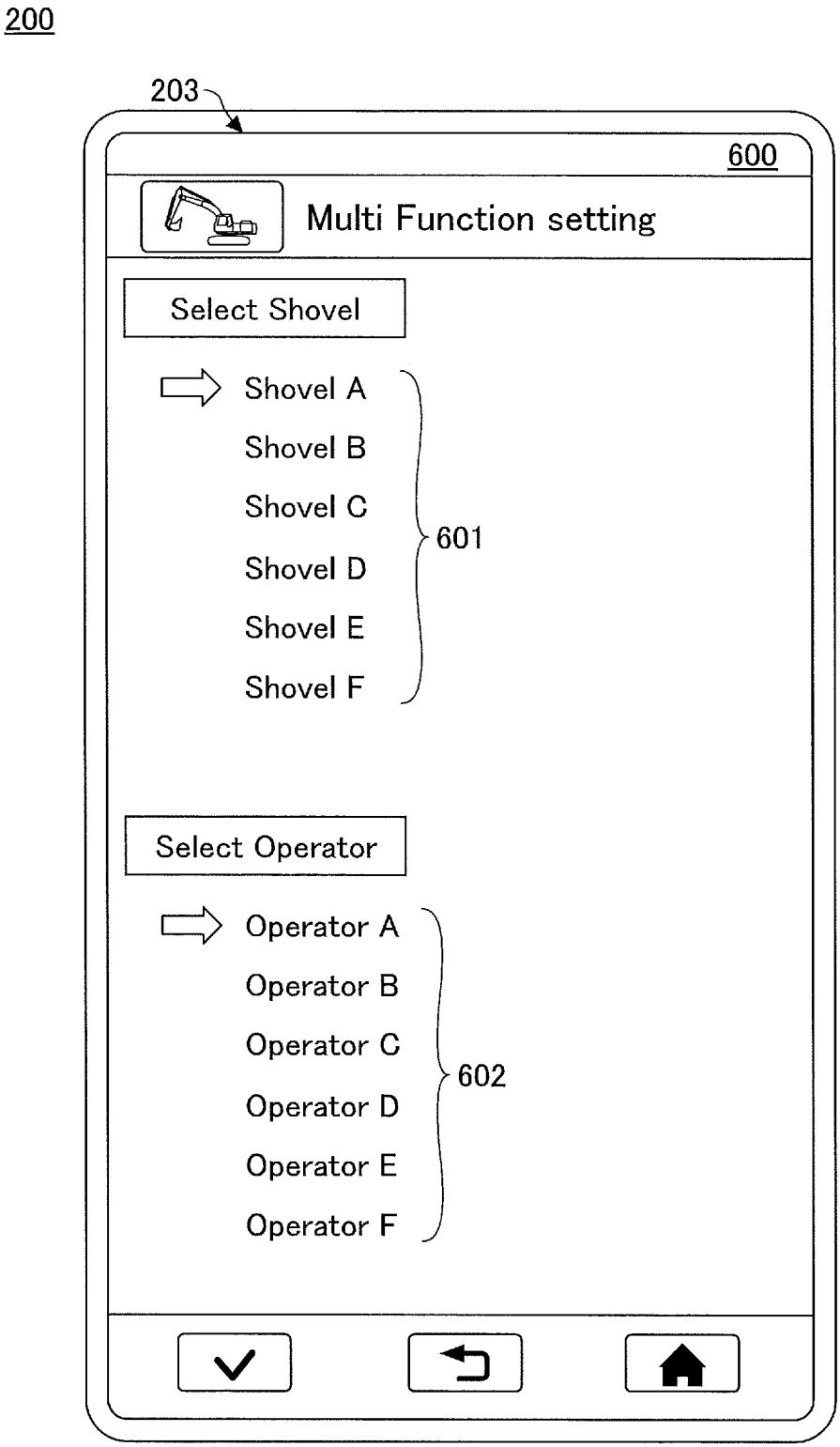
FIG. 6 is a diagram illustrating an example of an excavator and operator selection screen.

FIG. 6 is a diagram illustrating an example of an excavator and operator selection screen (excavator and operator selection screen 600) displayed on the display device 203 of the support terminal 200.

An operation screen similar to the excavator and operator selection screen 600 may also be displayed on the display device 153 of the management device 150, as described above.

As illustrated in FIG. 6, the excavator and operator selection screen 600 includes a list 601 of a plurality of selectable excavators 100, and a list 602 of a plurality of selectable operators.

The user may confirm and enter the excavator 100 or the operator, that is the target to be set, by performing an operation to select and determine one of the excavators 100 or the operators, through the operation input device 204 (for example, a touchscreen panel implemented in the display device 203). Then, the display contents of the display device 203 make a transition from the excavator and operator selection screen 600 to the setting target combined operation selection screen.

Although the embodiments of the prevent invention are heretofore described in detail, the present invention is not limited to specific embodiments, and various variations and modifications may be made without departing from the scope of the present invention as defined in the claims.

For example, in the embodiments described above, the operating device 26 is a hydraulic type that outputs a pressure signal (pilot pressure) of a hydraulic pressure according to the operating state selected by the operator, but may be an electric type that outputs an electrical signal. In this case, the control valve 17 may be configured to include an solenoid controlled pilot operated valve driven by the electrical signal according to the operating state, input directly from the operating device 26 or indirectly through the controller 30 or the like.

Further, in the above described embodiments and modifications, the relative reactivities are set based on the plurality of operation screens that are prepared hierarchically as illustrated in FIG. 3 through FIG. 6, but the setting of the relative reactivities is not limited thereto. More particularly, the operation screen display processing units 301, 1511, and 2011 may cause a direct transition to the relative reactivity setting screen when a predetermined option (for example, a button icon) for making a screen transition, displayed on a predetermined operation screen (for example, a so-called home screen) displayed on the display devices 40, 153, and 203, is operated through the operation input devices 42, 154, and 204. In this case, the combined operation that is the target to be set may be switched according to the operation performed on the relative reactivity setting screen through the operation input devices 42, 1514, and 2014. In addition, in this case, the registration contents (the initial setting 3031, the reference setting 3032, the customized setting 3033, or the like) of the storage units 303, 1513, and 2013 may be called according to the operation performed on the relative reactivity setting screen through the operation input devices 42, 154, and 204, and the registration contents may be reflected on the relative reactivity setting screen.

Moreover, in the above described embodiments and modifications, the bar graphs are utilized as display targets visually indicating the relative reactivities of the two hydraulic actuators during the combined operation, as illustrated in FIG. 4A through FIG. 4D, however, the display targets are not limited such bar graphs. For example, arbitrary graph displays used in various kinds of meters for digital displays, such as a pie graph or the like, may be employed in place of the bar graphs. In other words, the relative reactivity setting screen may indicate, in an arbitrary manner, the degree of distribution of the setting with respect to the operation speeds according to the trade-off for each of the two hydraulic actuators during the combined operation.

Further, in the above described embodiments and modifications, the relative reactivities of the two hydraulic actuators during the combined operation corresponding to the current setting 3030 are realized by individually adjusting the discharge amount of the main pumps 14L and 14R, but the manner of realizing the relative reactivities is not limited thereto. For example, a proportional solenoid valve that can vary a flow passage area of the pilot line on the secondary side of the operating device 26 may be controlled from the controller 30, to adjust the pilot pressure acting on the pilot port of the control valve corresponding to at least one of the two hydraulic actuators. In this case, since the pilot pressure different from the actual operating state of the operating device 26 acts on the pilot port of the control valve corresponding to one of the two hydraulic actuators, it is possible to adjust the flow rate distribution of the hydraulic oil to the two hydraulic actuators. In addition, the controller 30 may control a sub spool of the control valve corresponding to at least one of the two hydraulic actuators, for example. The flow rate of the hydraulic oil to the hydraulic actuators may be adjusted in this manner. In this case, it is possible to adjust the flow rate distribution of the hydraulic oil to the two actuators.

Moreover, in the above described embodiments and modifications, the settable contents of the relative reactivities of the two hydraulic actuators during the combined operation, may be different according to user's access privileges or the like. More particularly, a service person or the like may be able to set the relative reactivities in greater detail than as illustrated in FIG. 4A through FIG. 4D. More specifically, the operation screen display processing unit 301 may display a setting target combined operation selection screen or a relative reactivity operation screen that can make a more detailed setting, according to an access privilege authentication based on the input of a user ID, a password, or the like preassigned to the service person or the like. For example, the operation screen display processing unit 301 may display the setting target combined operation selection screen that displays a larger number of kinds of selectable combined operations than normal, based on the access privilege authentication or the like. For example, the operation screen display processing unit 301 may also display the relative reactivity setting screen that can continuously vary the relative reactivities rather than in steps, based on the access privilege authentication or the like. For example, the operation screen display processing unit 301 may also display the relative reactivity setting screen that can set a specific physical quantity (for example, the flow rate supplied to the hydraulic actuators, and the discharge amount of the main pumps 14L and 14R), a control quantity (for example, the control current value to the regulators 13L and 13R), or the like related to the two hydraulic actuators during the combined operation, based on the access privilege authentication or the like. Hence, while allowing the simple setting of the relative reactivities by the operator or the like, the service person or the like can make the detailed setting of the relative reactivities.

Further, in the above described embodiments and modifications, the relative reactivity setting screens illustrated in FIG. 4A through FIG. 4D display the plurality of kinds of combined operations as the targets to be set. However, the relative reactivity setting screens illustrated in FIG. 4A through FIG. 4D may of course be employed in the case of an excavator that only sets one specific kind of combined operation.

In the above described embodiments and modifications, the excavator 100 is configured to hydraulically drive the various operating elements such as the undercarriage 1, the slewing upper structure 3, the boom 4, the arm 5, the bucket 6, or the like, however, some of the operating elements of the excavator 100 may be electrically driven. In other words, the configuration or the like disclosed in the above described embodiments may be applied to a hybrid excavator, an electric excavator, or the like.

According to the above described embodiments and modifications, it is possible to provide an excavator or the like which can further improve the operability of the combined operations.

It should be understood that the invention is not limited to the above described embodiments, but may be modified into various forms on the basis of the spirit of the invention. Additionally, the modifications are included in the scope of the invention.

What is claimed is:

1. An excavator comprising:

a plurality of hydraulic actuators; and a setting unit that performs a setting related to operation speeds of the plurality of hydraulic actuators during a combined operation in which at least two hydraulic actuators among the plurality of hydraulic actuators are operated simultaneously, so that when the operation speed of a first hydraulic actuator of the at least two hydraulic actuators increases, the operation speed of a second hydraulic actuator of the at least two hydraulic actuators decreases, wherein the setting unit is configured to perform the setting for a plurality of kinds of combined operations which use different combinations of two hydraulic actuators, respectively, and the plurality of kinds of combined operations include at least two combined operations selected from a group consisting of a first combined operation of an arm in operation and a boom up operation during a fine grading, a second combined operation of the arm in operation and a bucket close operation during a digging, a third combined operation of the arm in operation and the boom up operation during the digging, a fourth combined operation of the bucket close operation and the boom up operation during the digging, and a fifth combined operation of the boom up operation and a swing operation of a slewing upper structure during a loading.

2. The excavator as claimed in claim 1, further comprising:

a storage unit that pre-registers reference contents of the setting, for each of a plurality of accessory specifications applicable to the excavator, wherein the setting unit selectively sets the operation speeds of the hydraulic actuators during the combined operation to the reference contents corresponding to one accessory specification among the plurality of accessory specifications, according to a user operation.

3. The excavator as claimed in claim 1, further comprising:

a registration unit that registers contents of the setting made by the setting unit in a storage unit, according to a user operation, wherein the setting unit sets the setting related to the operation speeds of the hydraulic actuators during the combined operation to the contents registered in the storage unit, according to the user operation.

4. The excavator as claimed in claim 1, further comprising:

a storage unit in which contents of an initial setting of the operation speeds of the hydraulic actuators during the combined operation are pre-registered, wherein the setting unit returns the operation speeds of two hydraulic actuators during the combined operation, changed from the contents of the initial setting, back to the contents of the initial setting, according to a user operation.

5. The excavator as claimed in claim 1, further comprising:

a display device configured to display an operation screen, wherein the setting unit sets the operation speeds of the hydraulic actuators during the combined operation, according to a user operation with respect to the operation screen.

6. An excavator comprising:

a plurality of hydraulic actuators;

a setting unit that performs a setting related to operation speeds of the plurality of hydraulic actuators during a combined operation in which at least two hydraulic actuators among the plurality of hydraulic actuators are operated simultaneously, so that when the operation speed of a first hydraulic actuator of the at least two hydraulic actuators increases, the operation speed of a second hydraulic actuator of the at least two hydraulic actuators decreases; and a display device configured to display an operation screen, wherein the setting unit is configured to perform the setting for a plurality of kinds of combined operations which use different combinations of two hydraulic actuators, respectively, the setting unit sets the operation speeds of the hydraulic actuators during the combined operation, according to a user operation with respect to the operation screen, the operation screen includes an image of the excavator representing a combined operation that is a target to be set among the plurality of kinds of combined operations, and the setting unit performs the setting according to the user operation with respect to the image of the excavator on the operation screen, or an image representing the combined operation that is the target to be set and accompanying the image of the excavator.

7. The excavator as claimed in claim 6, wherein the setting unit varies the operation speed of two hydraulic actuators during the combined operation, according to the user operation with respect to a portion of operating elements driven by the two hydraulic actuators corresponding to the combined operation that is the target to be set in the image of the excavator, or the user operation with respect to an icon indicating an operating direction of an operating element accompanying the image of the excavator.

8. An excavator comprising:

a plurality of hydraulic actuators;

a setting unit that performs a setting related to operation speeds of the plurality of hydraulic actuators during a combined operation in which at least two hydraulic actuators among the plurality of hydraulic actuators are operated simultaneously, so that when the operation speed of a first hydraulic actuator of the at least two hydraulic actuators increases, the operation speed of a second hydraulic actuator of the at least two hydraulic actuators decreases; and a display device configured to display an operation screen, wherein the setting unit is configured to perform the setting for a plurality of kinds of combined operations which use different combinations of two hydraulic actuators, respectively, the setting unit sets the operation speeds of the hydraulic actuators during the combined operation, according to a user operation with respect to the operation screen, and the operation screen displays a degree of distribution of the setting with respect to the operation speeds according to a trade-off for each of two hydraulic actuators during the combined operation that is a target to be set among the plurality of kinds of combined operations.

* * * * *